US011125474B2

(12) United States Patent
Ahmad et al.

(10) Patent No.: US 11,125,474 B2
(45) Date of Patent: Sep. 21, 2021

(54) SELF-ICE MAKING / SELF HEATING HYBRID FOOD AND BEVERAGE STORAGE CHEST

(71) Applicants: Mohammad Sharaz Ahmad, Sacramento, CA (US); Mohammad Ali Ahmad, Sacramento, CA (US); Nadeem Ahmad, Sacramento, CA (US)

(72) Inventors: Mohammad Sharaz Ahmad, Sacramento, CA (US); Mohammad Ali Ahmad, Sacramento, CA (US); Nadeem Ahmad, Sacramento, CA (US)

( * ) Notice: Subject to any disclaimer, the term of this patent is extended or adjusted under 35 U.S.C. 154(b) by 69 days.

(21) Appl. No.: 15/607,313

(22) Filed: May 26, 2017

(65) Prior Publication Data

US 2017/0343247 A1 Nov. 30, 2017

Related U.S. Application Data

(60) Provisional application No. 62/341,992, filed on May 26, 2016.

(51) Int. Cl.
*F25B 9/04* (2006.01)
*A45C 11/20* (2006.01)
(Continued)

(52) U.S. Cl.
CPC ..... *F25B 9/04* (2013.01); *A45C 11/20* (2013.01); *F25D 3/06* (2013.01); *F25D 11/003* (2013.01);
(Continued)

(58) Field of Classification Search
CPC ..... F25B 9/04; F25B 9/02; F25B 2309/022; F25D 3/06; F25D 11/003; F25D 23/026; F25D 31/005; F25D 2303/0831; F25D 2400/38; F25D 23/065; F25D 2201/12; F25D 2300/00; F25D 1/06; B65D 81/18; B65D 81/3484; B65D 81/38; B65D 81/813813; B65D 81/3823; B65D 81/3811; A47J 41/0044
USPC ..... 220/592.01, 592.02, 592.03, 592.09, 220/592.1, 592.2, 592.26, 592.28; 62/5; 206/541, 545
See application file for complete search history.

(56) References Cited

U.S. PATENT DOCUMENTS 4,326,383 A * 4/1982 Reed ..... F25B 21/02 62/3.62
4,865,012 A * 9/1989 Kelley ..... A61F 7/02 126/204
(Continued)

*Primary Examiner* — Justin M Jonaitis

(57) ABSTRACT

A refrigerated food storage box has been disclosed. This refrigerated food storage box has an inner box comprising a set of inner walls and an inner base, together enclosing a food storage compartment. There is also an outer box comprising a set of outer walls and an outer base, wherein each outer wall is located at a predetermined distance from a corresponding inner wall and the outer base is located at the predetermined distance from the inner base, thereby creating a thermal cavity between the inner box and the outer box. There is at least one plate-type heat exchanger located within the thermal cavity, wherein each plate-type heat exchanger having a hollow cavity therein. Note that the hollow cavity capable of receiving temperature controlled air from a refrigeration unit, thereby capable of altering the temperature inside the food storage compartment.

17 Claims, 24 Drawing Sheets

(51) Int. Cl.

| | |
|---|---|
| ***F25D 3/06*** | (2006.01) |
| ***F25D 11/00*** | (2006.01) |
| ***F25D 23/02*** | (2006.01) |
| ***F25D 31/00*** | (2006.01) |

(52) U.S. Cl.
CPC ..... *F25D 23/026* (2013.01); *F25D 31/005* (2013.01); *F25D 2303/0831* (2013.01); *F25D 2400/38* (2013.01)

(56) References Cited

U.S. PATENT DOCUMENTS

| | | | | | |
|---|---|---|---|---|---|
| 5,301,508 | A * | 4/1994 | Kahl | F25B 21/02 | 16/444 |
| 5,572,872 | A * | 11/1996 | Hlavacek | A47G 23/04 | 62/3.3 |
| 5,603,220 | A * | 2/1997 | Seaman | A61J 1/165 | 62/3.62 |
| 5,771,788 | A * | 6/1998 | Lee | A21C 13/00 | 435/286.1 |
| 6,619,070 | B2 * | 9/2003 | Shin | A23B 7/0425 | 62/407 |
| 6,715,299 | B2 * | 4/2004 | Kim | A45D 44/00 | 62/3.6 |
| 2006/0076379 | A1 * | 4/2006 | Hussaini | B60R 7/043 | 224/275 |
| 2006/0250061 | A1 * | 11/2006 | Cheon | F25D 23/066 | 312/401 |

* cited by examiner

SELF-ICE MAKING / SELF HEATING HYBRID FOOD AND BEVERAGE STORAGE CHEST

CROSS-REFERENCE TO RELATED APPLICATIONS

This non-provisional application takes benefit from provisional application 62/341,992, filed on May 26, 2016.

TECHNICAL FIELD

The present invention relates to the field of storage boxes and, more particularly, to a refrigerated food storage box.

BACKGROUND OF THE INVENTION

Refrigerated food storage boxes, also known as, portable ice chest coolers have been around since the first one was invented in 1951 (U.S. Pat. No. 2,663,167) to cool and preserve food and beverages in situation where there is no electrical power for running regular refrigeration equipment. Ice chest coolers are an essential part of all outdoors activities such as camping, fishing, hunting, picnicking, tailgating at sporting events, back yard barb eques to name just a few.

The basic design of an ice chest cooler has remained the same for the last seven decades. An ice chest cooler generally included an insulated, double-walled container made of sturdy materials such as steel in the early days. Eventually switch was made to plastics, mainly due to their durability, strength and much lighter weight. Food grade Polyethylene plastics have almost exclusively replaced as materials of choice for ice chest coolers of today.

Ice chest coolers are double walled insulated boxes with an insulated detachable or an attached hinged lid that can be opened to grant access to the storage compartment cavity having a base at the bottom and having walls rising up from the base on all four sides to form a cavity and are usually of rectangular shape with an open top. Ice, food and drinks are placed together in the storage compartment cavity and the lid closed. Maximizing ice retention is always of paramount importance since the longer the ice lasts the longer the food and drinks remain cold and longer the time between replacing the ice which is a hassle to do, since ice is not always convenient to replace because it is not always readily available.

As an example, a leading manufacturer of premium quality 45 quarts size ice chest cooler has found that about 35 lbs of ice should be placed in the cooler, leaving enough room for only 26 soda or beer cans. The weight of the ice makes the cooler heavy and harder to carry, while replacing that much ice is not always easy, for maximum ice retention all manufactures recommend maximum quantity of ice should be loaded into the cooler at the expense of sacrificing the quantity of food and drink that can be accommodated.

Also, after a few days, the ice gets converted to water and creates a mess especially if the water seeps into dry goods, sandwiches and meats etc., causing spoilage and cross contamination and even health problems. Hence, there is a need for designing better food storage boxes which can overcome the above-mentioned issues.

SUMMARY

With the foregoing in mind, the present invention seeks to provide a novel refrigerated food storage box (also known as ice chest cooler as it is mostly used for keeping items cold) that will make it possible to control temperature of food and drinks, without having to place ice in the food storage compartment.

In one preferred embodiment, the present invention is a refrigerated food storage box having an inner box comprising a set of inner walls and an inner base, together enclosing a food storage compartment. The refrigerated food storage box also includes an outer box comprising a set of outer walls and an outer base, wherein each outer wall is located at a predetermined distance from a corresponding inner wall and the outer base is located at the predetermined distance from the inner base, thereby creating a thermal cavity between the inner box and the outer box.

In addition, there is at least one plate-type heat exchanger located within the thermal cavity, wherein each plate-type heat exchanger having a hollow cavity therein. The wherein the hollow cavity capable of receiving temperature controlled air from a refrigeration unit, thereby capable of altering the temperature inside the food storage compartment In another aspect, the refrigerated food storage box also has a hinged lid cover for covering a top portion of the refrigerated food storage box.

In another aspect, the hinged lid cover has a cavity with a plate-type heat exchanger placed within.

In another aspect, the set of inner walls and the inner base are made of food grade plastics.

In another aspect, an exterior surface of the outer box is covered with at least one layer of insulated material.

In another aspect, the outer box and the inner box are interlocked with each other by a set of standoffs.

In another aspect, each plate-type heat exchanger has through holes for allowing the stand offs to pass through and create and interlock the outer box with the inner box.

In another aspect, the refrigeration unit comprises a vortex tube for producing streams of hot and cold air.

In another aspect, the refrigeration unit further comprises a plurality of gas transmission lines for transferring one of hot and cold air from the vortex tube to the plate-type heat exchanger.

In another aspect, the refrigeration unit includes a valve for selecting one of hot air and cold air to be transferred from the vortex tube to the plate-type heat exchanger.

In another aspect, the thermal cavity is filled with water.

In another aspect, cellulose fiber based saw dust is mixed with the water in thermal cavity in a ratio between 5%-15% by weight.

In another aspect, the thermal cavity is filled with a mixture of water and Ethylene Glycol.

In another aspect, the refrigerated food storage box also has a set of retractable wheel assembly coupled thereto for transporting the refrigerated food storage box.

In another aspect, the refrigerated food storage box also has a quick engage and release locking mechanism for locking and unlocking the hinged lid cover with the rest of the refrigerated food storage box.

BRIEF DESCRIPTION OF DRAWINGS

Now looking at several illustrations to follow these and other advantages will more fully appear from the following description made in connection with the accompanying drawings wherein like references characters refer to the same or similar parts throughout the several views and in which.

DETAILED DESCRIPTION OF DRAWINGS

Figure 1:
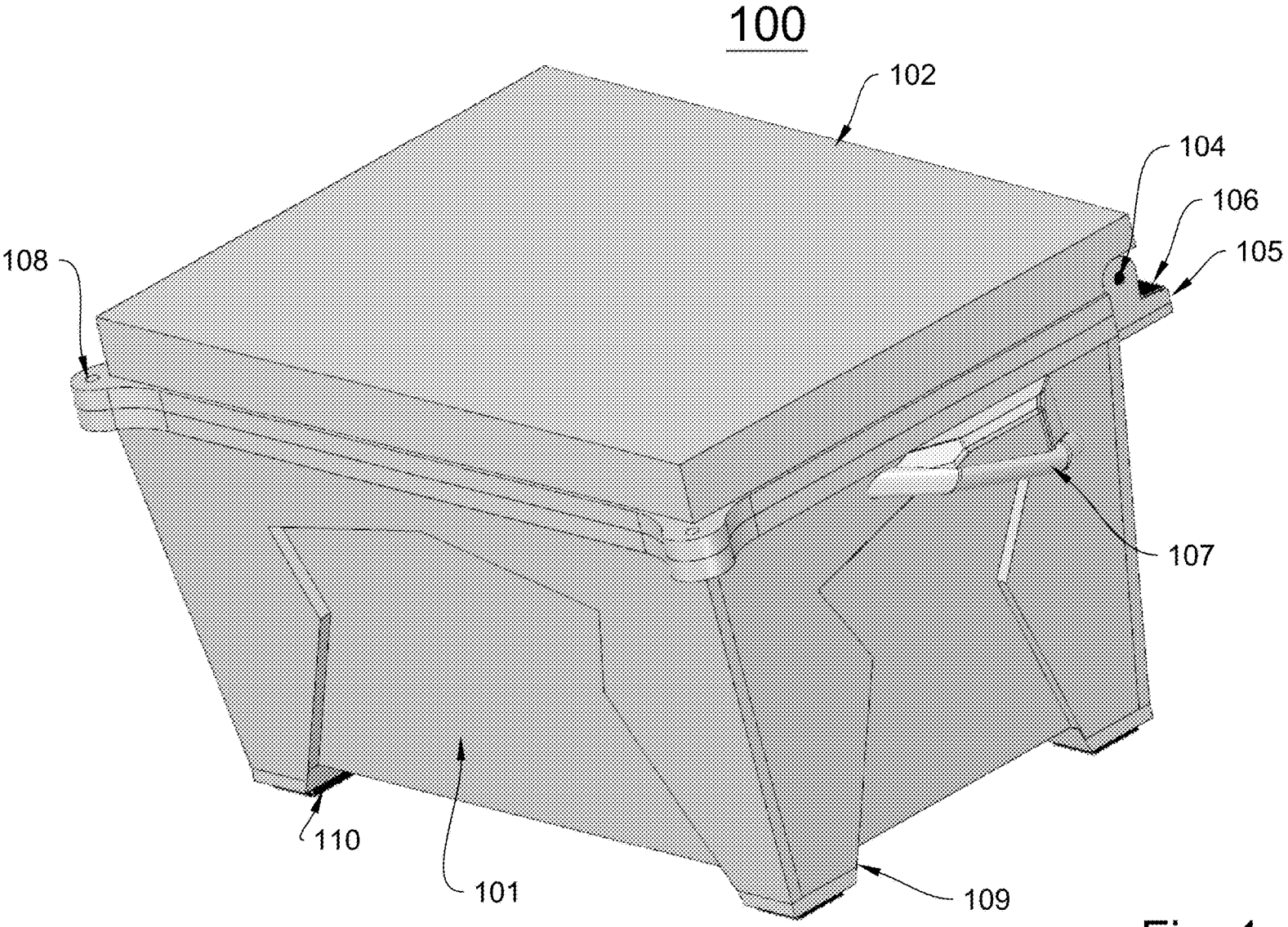
FIG. 1 is a perspective front top view of the refrigerated food storage box disclosed herein showing a hinged lid cover in closed position.

As illustrated in FIG. 1, there is shown a perspective view of a portable refrigerated food storage box 100 having an outer box 101 and a hinged lid cover 102 (also referred as hinged lid 102), the hinged lid cover is attached to the bottom box with a metal pin 104 preferably made of a corrosion resistant non-rusting metal, like aluminum or stainless steel.

The outer box 101 may have a double walled structure, the double walls forming an insulation cavity between them. This insulation cavity may be filled with pressure injected insulation. This insulation cavity injected with insulation adds to the refrigeration and insulation capacity of the refrigerated food storage box 100. Note that the outer box 101 may also be termed as the outer double walled box 101 due to its proposed double walled structure.

To prevent the lid from over extending when opened so as to minimize the stress on the hinges that may cause them to break a travel stop lid stop ridge 105 running along the entire back side of the box 101 is provided. A rubber bumper 106 is provided running along the entire length of the ridge to cushion the impact of the back of the lid 102 when fully opened and contacting the box 101. Ergonomically designed angled handles 107 to reduce stress on wrists with built in tie down strap holes are provided on either side of the cooler 100 making it more comfortable to carry. Pad lock holes 108 are provided on either side of the outer most contact point between the lid 102 and the box 101. To make it easier to wash under the ice chest cooler when on a truck bed or a boat, four raised feet 109 are designed into the outer box 101, providing adequate clearance between the floor and the bottom side of the cooler. To ensure the cooler stays put rubber non-slip pads 110 are provided at the bottom of each of the raised feet 109.

Figure 2:
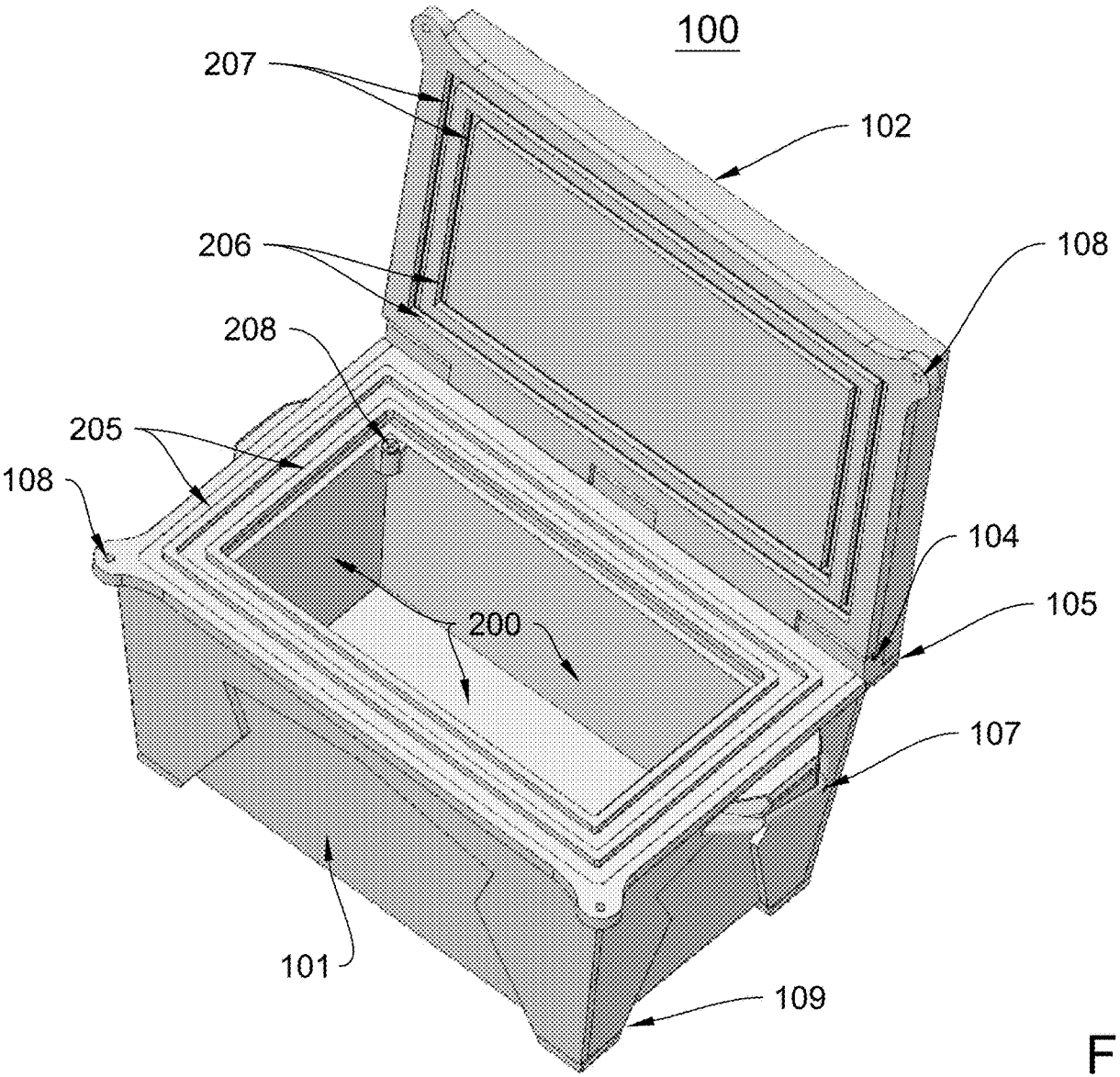
FIG. 2 is a perspective front top view of the refrigerated food storage box disclosed herein showing the hinged lid cover in open position.

In FIG. 2, the proposed refrigerated food storage box 100 (also alternatively termed as ice chest cooler 100) is depicted with its hinged lid cover 102 in the open position giving a clear view of the inner box 200 whose side-walls and inner base encloses a food storage compartment. Note that the side walls and base of the inner box are made of food grade plastics. To ensure the cooling is not lost a freezer type plurality of gasket seals are proposed, in this case two are provided, an outer and an inner seal. The sealing mechanism comprises of double ridges 205 running along the flat top on all 4 sides, rising up at 90 degrees from the top surface of the flange 200-1 (See FIG. 3-1) of inner box 200. Recessed channels 206 are provided on the inside of the hinged lid cover 102 so as to accommodate the inner and outer ridges 205 into the channels 206. To the top surface of the channel 206 there are attached freezer style rubber gaskets 207, when pushed by ridges 205, rubber gaskets 207 compresses vertically and expands horizontally against the walls of the channel 206 and the top of the ridges 205 to form an air tight seal in three directions, thereby keeping the cold in and the heat out. Inside the food storage compartment 200 a water and air tight liquid filler port 208 with a detachable cap is provided. The filler hole 208 can be used to pour thermal storage medium like water and other additives into the water and air tight cavity 103 (also referred to as thermal storage cavity 103, see FIGS. 3 & 4) formed between the outer doubled walled box 101 and the inner box 200 due to difference between the size of the inner box 200 and outer box 101. Examples of additives include Ethylene Glycol and cellulose fiber based saw dust is mixed with the water in a ratio between 5%-15% by weight. Lower side of the flange 200-1 of the inner box 200 can sit on top of the top side of the flange 101-1 of the larger outer box 101 totally sealing the thermal storage cavity 103. Note that the inner box 200 and the outer box 101 are separated by a predetermined distance.

Alternatively, a box can be molded in one piece having plurality of cavities whereby access panels can be cut afterwards to install parts that will reside inside the cavity.

In one embodiment of the present invention, the thermal storage cavity 103, or the, of the ice chest cooler can be filled with water or ice through an insulated access panel, this design can minimize exposure of the ice to the elements each time the lid is opened to grant access to the larger inner food storage cavity, since the ice can reside in a totally sealed cavity this arrangement can also provide better insulation due to no exposure to the outside warm air and sun light thereby, making the ice last longer while freeing up the entire volume of the food storage compartment for food and drinks.

In yet another embodiment, it is proposed that the temperature of the ice in the thermal storage cavity be kept much lower than store bought ice to increase it thermal storage capacity, therefor, allowing for much more cooling to be supplied over longer durations, thereby, increasing the time between charging the ice in the thermal storage cavity. It is proposed one way to accomplish this is to add a good natural or engineered freezing point depression agent like salt into the water to retard it phase change from liquid to solid at 32° F. (0° C.), the delay in phase change at much lower temperature can yield significantly higher thermal storage capacity, affording higher cooling capacity than at the normal freezing point of a given liquid. Alternatively, in place of water and other additives a good thermal storage medium like Ethylene Glycol and water mixture or Ethylene Glycol by its self can be used due to its much lower freezing point allowing for a much higher thermal storage capacity due to lower phase change properties.

In addition to water and cellulose fiber material or only water or a thermal storage liquid medium a good thermal conductor like aluminum oxide can be added into the mix, while the cellulose fiber will insulate the ice and help resist melting addition of thermally conducting material will absorb the heat from the ice and be held away from it until the next cooling cycle so the absorbed heat can then be carried away giving the ice ability to resist melting.

Figure 3:
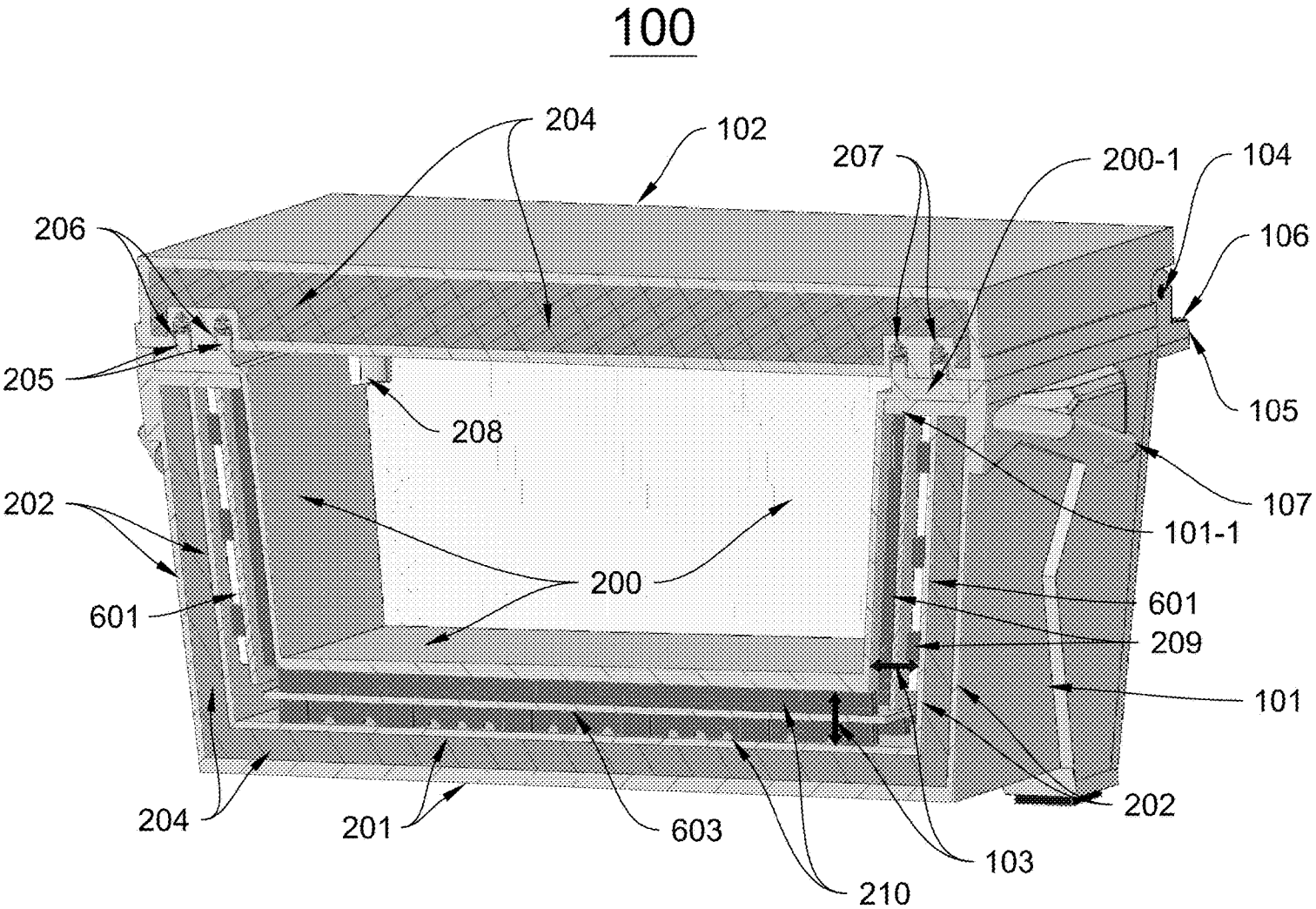
FIG. 3 is a front cutaway perspective view of the refrigerated food storage box disclosed herein, showing various internal parts and layers.

FIG. 3 presents a cutaway front right perspective view of the proposed refrigerated food storage box 100 is provided showing the various layers and internal parts of the cooler. Predetermined equal distance is maintained inside the thermal storage cavity 103, between the walls of the outer box 101 and inner box 200 by standoffs 209 in the walls and by floor joists type of standoffs 210 in the floor, (for better clarity see FIGS. 8 & 10) each standoff is composed of two parts, part one a permanent part of inner box 200 jutting out at 90 degrees in an outwardly direction (see FIG. 10 for clarity) from the outside walls and the floor on all five sides, standoffs 209 and 210 having plurality of protrusions. Part two of 209 and 210 standoffs being mirror image of part one, once attached side by side, protrusions of the permanently attached 209 and 210 can rest against the inner wall and floor of the outer box 101 while the protrusions of the mirror image resting against the outer walls of the inner box 200 each side of the standoffs forcing to maintain equal distance between outer box 101 and inner box 200 making a uniform thermal storage cavity 103 on all five sides. As the two standoffs are assembles the reversing of the protrusions cause slots 211 to be formed along the center of the standoffs (See FIG. 8 for clarity). In addition to the standoffs acting to maintain uniform distance between the walls and the floor of the opposing boxes, they also serve as standoff to hang and hold in place the plate type heat exchangers 601 and 603, at a predetermined distance from the walls and floor by allowing the passage of the protrusions of 209 and 210 through the slots 604 (See FIGS. 7 & 8 for clarity) in the heat exchangers as the second standoff 209 and 210 snap into place to lock in place the heat exchange plates from the opposing side isolating any movement of heat exchanger 601, 602 and 603 thereby, suspending the heat exchangers at a predetermined distance from all sides inside the cavity parallel to the walls and floor. As described earlier, a layer of good quality insulation 204 installed in between the outer double walled floor 201 and outer double walls 202, 203 (FIG. 4) rising upwardly from the floor to from the outer double walled box 101. Insulation is also installed in the cavity in between double walls of the lid 102. In an alternate implementation, the outer box may be single walled with a layer of insulating material, like plastic, cellulose, polyurethane foam etc. be embedded on the exterior surface of the outer box 101.

Alternatively, plurality of cavities in the lid 102 can be built, the outer cavity can accommodate insulation 204 while the inner cavity can accommodate its own standoffs and heat exchangers (see FIGS. 13, 13*a* and 13*b*) and air distribution lines just like in the walls and floor of the lower box, with a flex line jumping the connection from the lower box into the lid 102 to transfer cooling to the lid thermal storage cavity.

Even though the described implementations depict a cuboidal refrigerated food storage box with plate type heat exchangers mounted in the thermal storage cavity, other embodiments of the same invention may not include the plate type heat exchangers within the thermal storage cavity. Such implementations may not even include a vortex tube/refrigeration unit. Instead, the implementation has simple box shaped outer and inner box with a thermal storage medium, like water, ice, ethylene glucose, cellulose etc, or a mixture thereof installed within the thermal storage unit. Note that this implementation is a simple version of the same invention and is easier to carry and transport. Also note that the refrigerated food storage box may be available in shapes, other than cuboid, as per customer preference.

Figure 4:
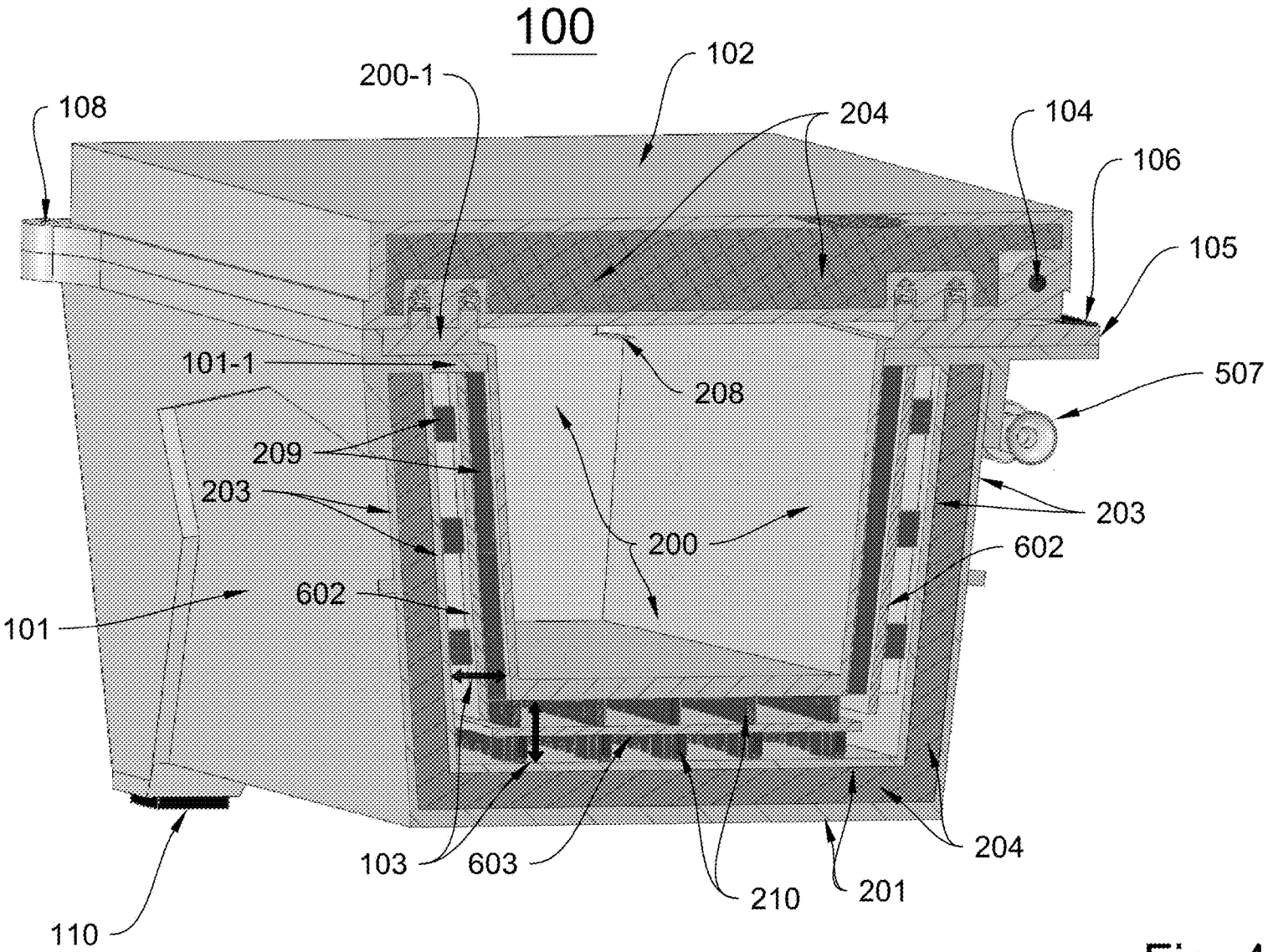
FIG. 4 is a side cutaway perspective view of the refrigerated food storage box disclosed herein, showing various internal parts and layers.

FIG. 4 is generally the same as the FIG. 3, showing the refrigerated food storage box from a right-side perspective view. In this view, some parts of a refrigeration unit are visible namely the chilled air distribution manifold 507 and side heat exchangers 602 (also known as plate-type heat exchangers). Alternatively, the chilled air distribution manifold can be installed inside the thermal storage cavity 103 with a main supply line running from 507 to the outside of the ice chest cooler where through a connection valve chilled or hot air can be introduced (not shown).

Figure 5:
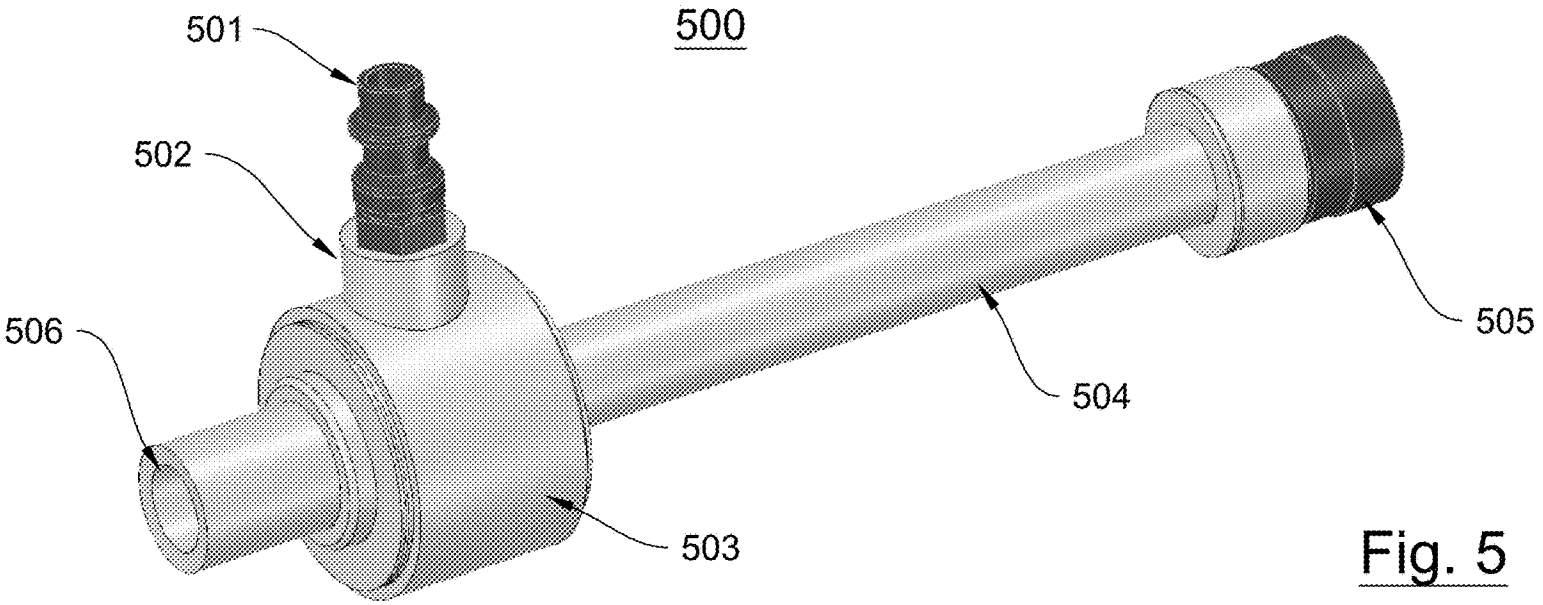
FIG. 5 is a close-up view of a Vortex Tube.

FIG. 5 is a perspective view of a Vortex tube which is an important component of the refrigeration unit of the refrigerated food storage box. A vortex tube 500 is shown with its various parts, 501 is the compressed air or any other compressed gas attachment nipple while 502 is the inlet port housing for the compressed gas inlet into the vortex tube, 503 is the swirl chamber, 504 is the long hollow shaft that houses the two separate streams one hot and the other a cold due to vortex action, hot stream being on the outside and cold towards the center of the vortex. 505 is the adjustment knob for the conical hot end outlet valve controlling flow rate and temperatures. 506 is the cold end exhaust port.

Figure 5A:
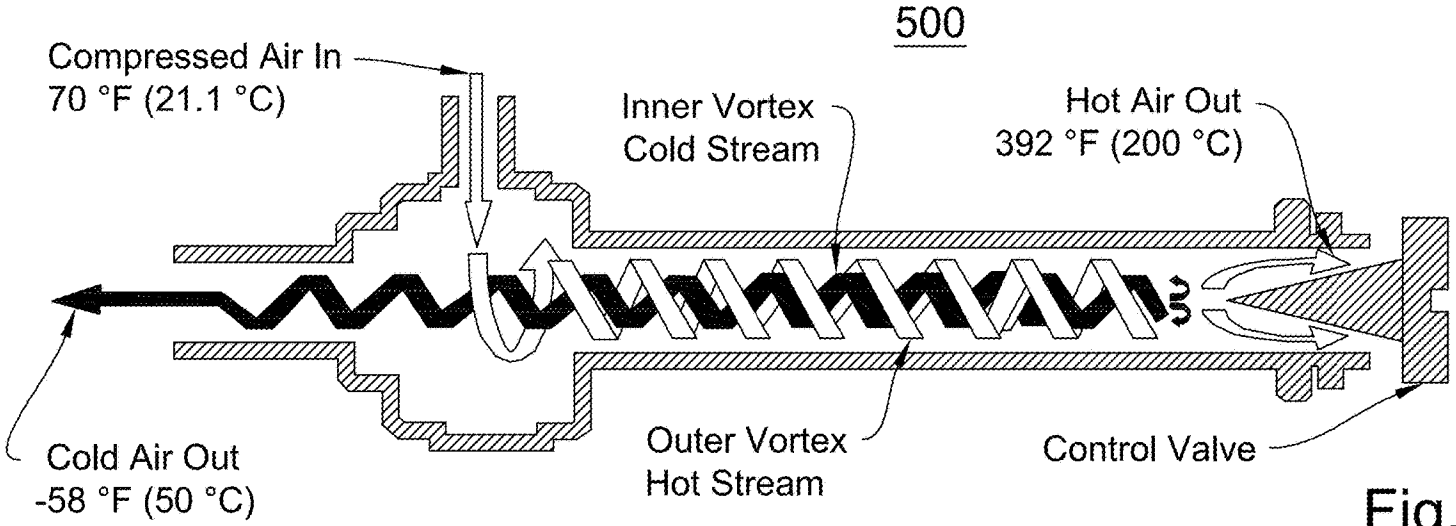
FIG. 5*a* is a cutaway view of the Vortex tube depicting separation of compressed gas into cold and hot streams due to swirling action inside the vortex tube.

FIG. 5A is a side cutaway view of a vortex tube, as compressed gas is introduced into the Vortex tube it passes through a vortex or swirl chamber (not shown), gas exiting the swirl chamber is spun at more than a million RPM and split into hot and cold streams, hot stream is allowed to exit through the conical hot end (FIG. 5, 505) while the cold stream is forced back in the opposite direction to exit through the cold end. The average thermal difference between the hot and cold end exhaust gases can be significant, in the range of minus 58° F. (minus 50° C.) of cold air and 392° F. (200° C.) of hot air.

Figure 6:
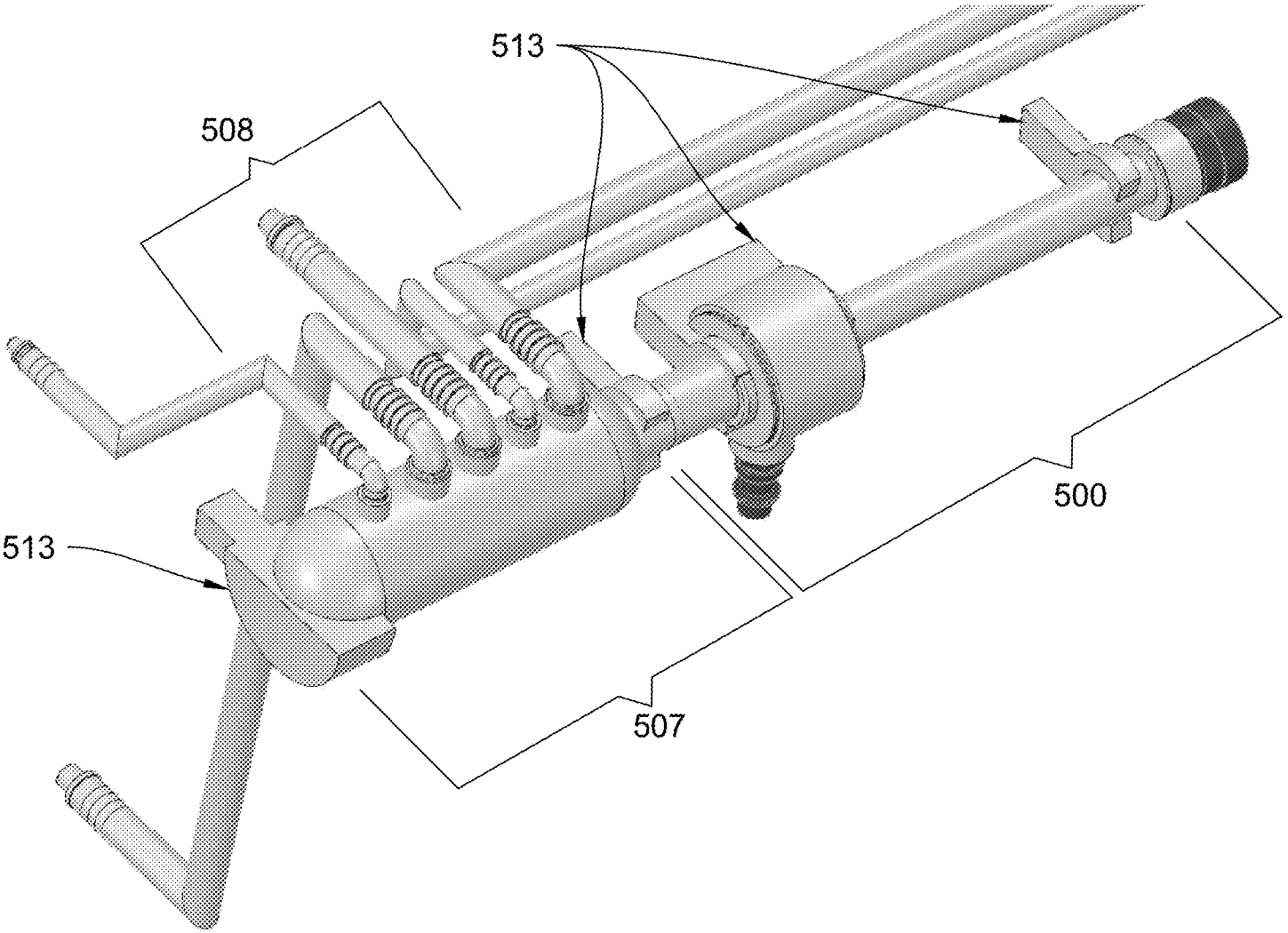
FIG. 6 is a back-perspective view of the entire cooling system of the refrigerated food storage box disclosed herein.

FIG. 6 is a perspective view of a vortex tube 500 and refrigeration unit. The cold end 506 of the vortex tube 500 is attached to a chilled air distribution manifold 507, having five outlet ports, a group of five chilled air distribution lines 508 are attached to five nipples on the manifold 507 to transmit chilled air to each of the five plate type heat exchangers 601, 602 and 603 (See FIG. 7 for clarity) located inside the thermal storage cavity 103. With continuous flow of air through gas transmission lines 508 (also part of the refrigeration unit) into the plate type heat exchanger 601, 602 and 603 heat transfer can take place, freezing the contents into ice, (or alternatively, heating them depending on whether the vortex tube transfers hot or cold air through the gas transmission lines) the stored cooling in the ice can then be provided as needed through conduction or forced air means into the inside of the inner box 200 food storage compartment. 513 are a series of mounting brackets to hold the Vortex tube 500 and air distribution manifold 507 in place.

Figure 7:
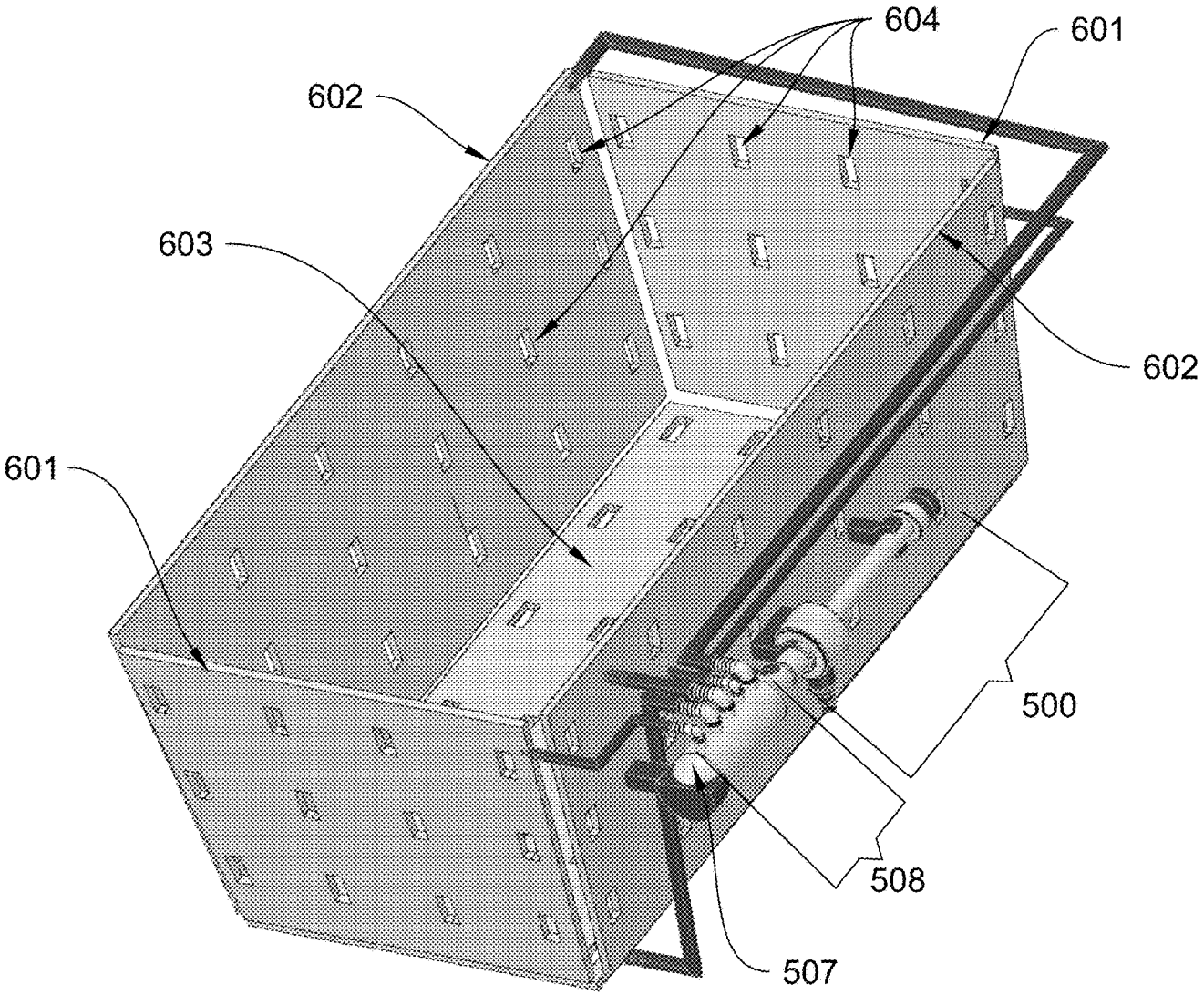
FIG. 7 is close up perspective view of the refrigeration unit of the refrigerated food storage box disclosed herein, including the plate type heat exchangers units.

FIG. 7 is a top side perspective view of the entire cooling system, or the refrigeration unit. There are five chilled air transmission lines 508 (or gas transmission lines), shown with the individual heat exchangers 601, 602 and 603 attached at the other end. The heat exchangers are shown with pass through holes 604 to accommodate the protrusions of the standoffs 209 and 210 (not shown in this view). The through holes 604 inside the plate type heat exchanger serve as points of disturbance causing significant turbulence inside the heat exchangers 601, 602 and 603 causing to accelerate the heat transfer between the heat exchanger plates 601, 602 and 603 and the thermal storage liquid they are immersed in, facilitating speedier cooling and eventual freezing of the liquid.

Figure 8:
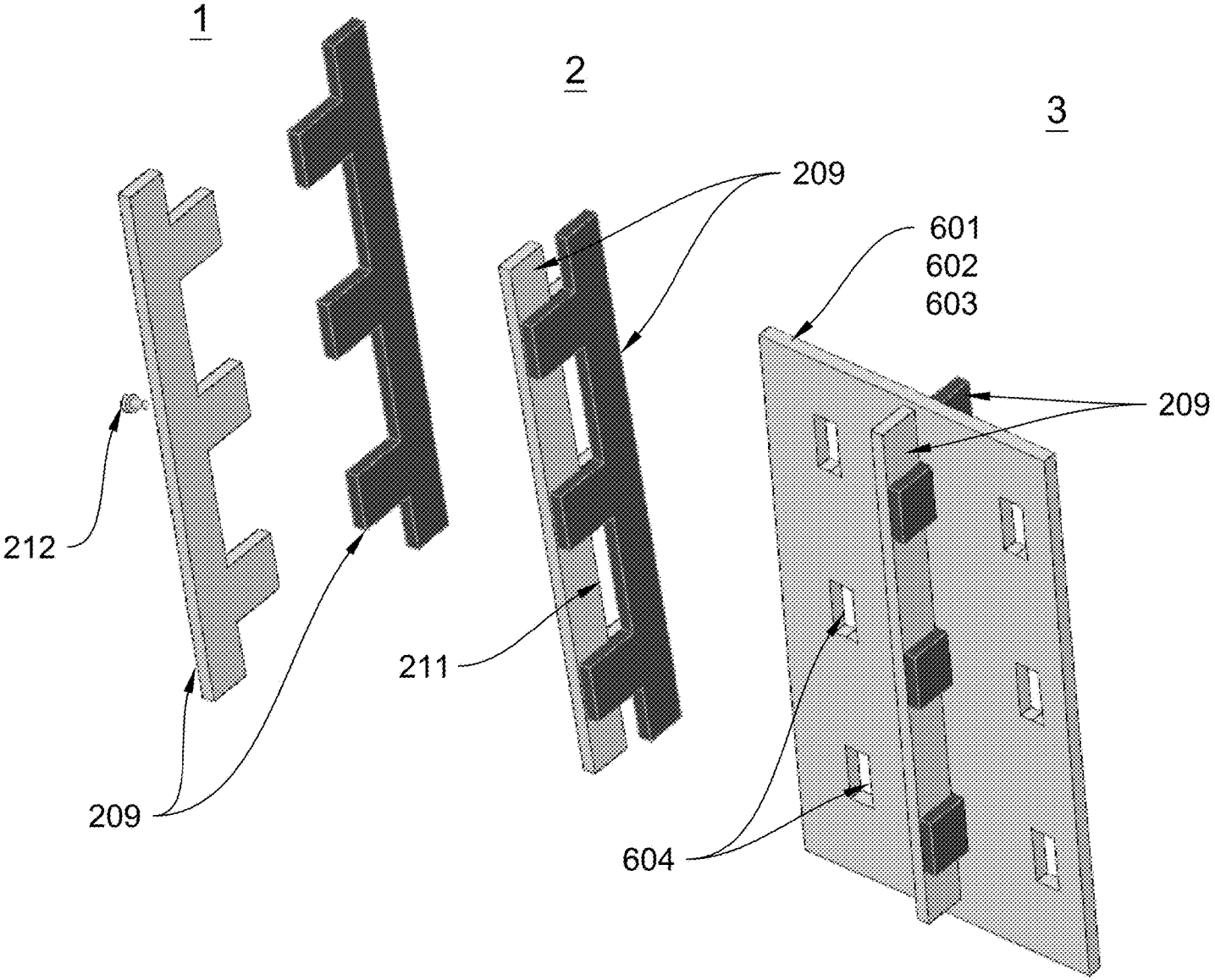
FIG. 8 is a view of the refrigerated food storage box disclosed herein, depicted are standoffs and plate-type heat exchanger and how they appear when disengaged, engaged and engaged holding the heat exchanger in place.

FIG. 8 is a right top perspective view of a series of three views of standoff in various arrangements. In scene "1" vertical wall standoffs 209 and mirror image of the second opposing part of 209 are shown in disengaged position (box 200 not shown as an integral part of section one of standoff 209). In scene "2" standoffs 209 are shown in engaged position showing the resulting plurality of slots 211 that can accommodate the plate type heat exchangers 601 and 602. Standoffs are held in place due to tight friction fit or a self-tapping screw 212 driven laterally into both parts of 209 standoffs and its mirror image. In scene "3" standoffs 209 are shown in engaged position while holding plate type heat exchanger 601, 602 in the slots 211 and slot 604 not only keeping it in place but holding the heat exchanger in a predetermined distance from and parallel to the walls. Floor standoffs 210 and floor heat exchanger 604 not shown as their arrangement is nearly identical.

Figure 9:
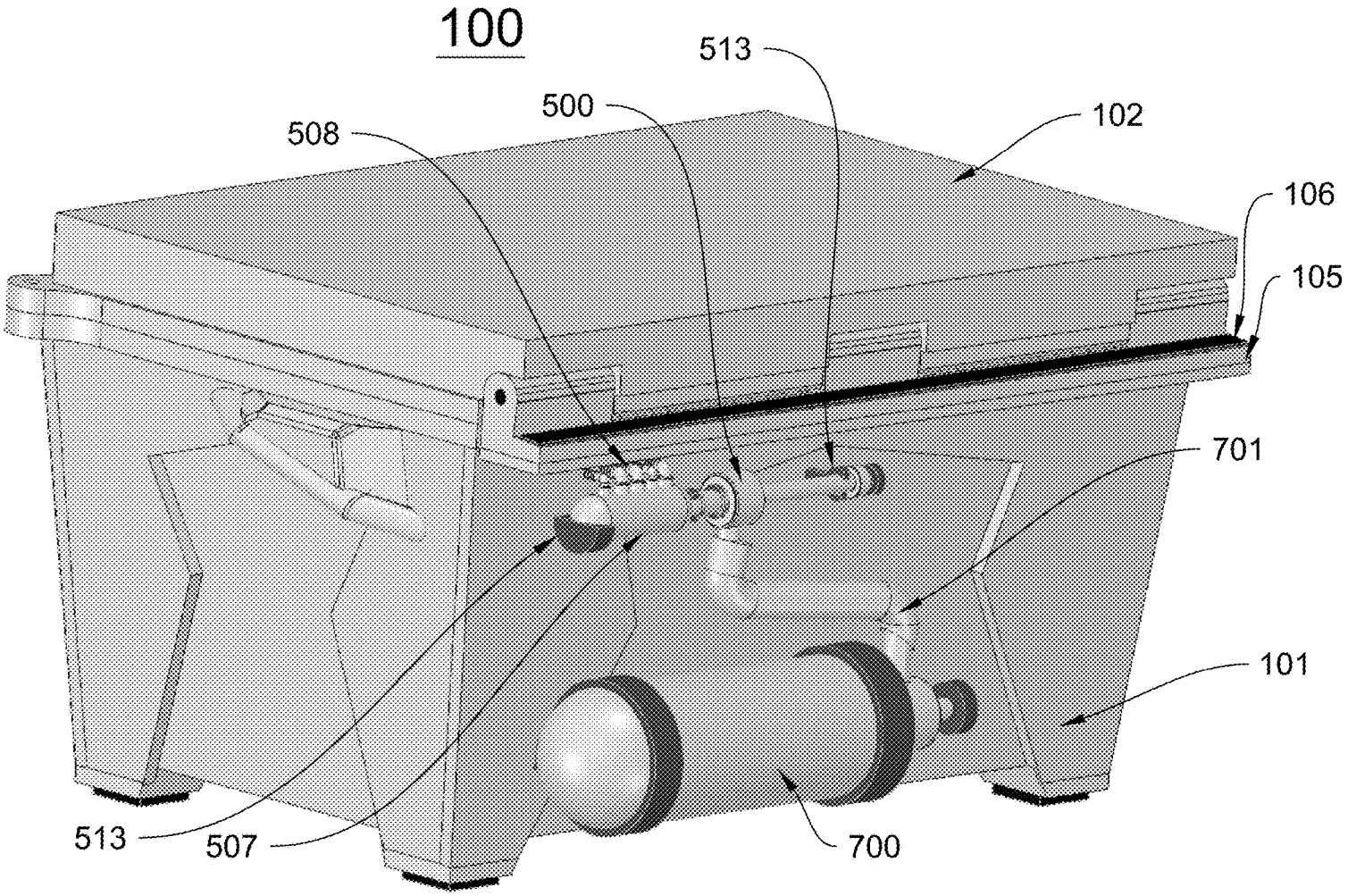
FIG. 9 is a perspective back view of the refrigerated food storage box disclosed herein, showing some of the attached cooling system components.

FIG. 9 is a back perspective view of the proposed invention ice chest cooler 100 showing exterior parts of the refrigeration unit. Vortex tube 500 is shown attached to the chilled air distribution manifold 507 attached by a series of brackets 513 to the main body of the outer lower box 101, with a group of five chilled air distribution lines 508 attached to nipples on 507 and entering into the outer lower box 101 to connect to the plate type heat exchangers 601, 602 and 603 (not shown) located inside the thermal storage cavity 103 (not shown). Optionally, a high-pressure air tank (HPA Tank) 700 can be detachably mounted with bracket or straps to the body of the cooler to be connect to the vortex tube via a flex line 701 to start the supply of pressurized gas with the press of a button thereby starting the cooling cycle. Note; that for embodiments having both heating and cooling cycle selection see FIG. 12 schematic diagram.

Figure 10:
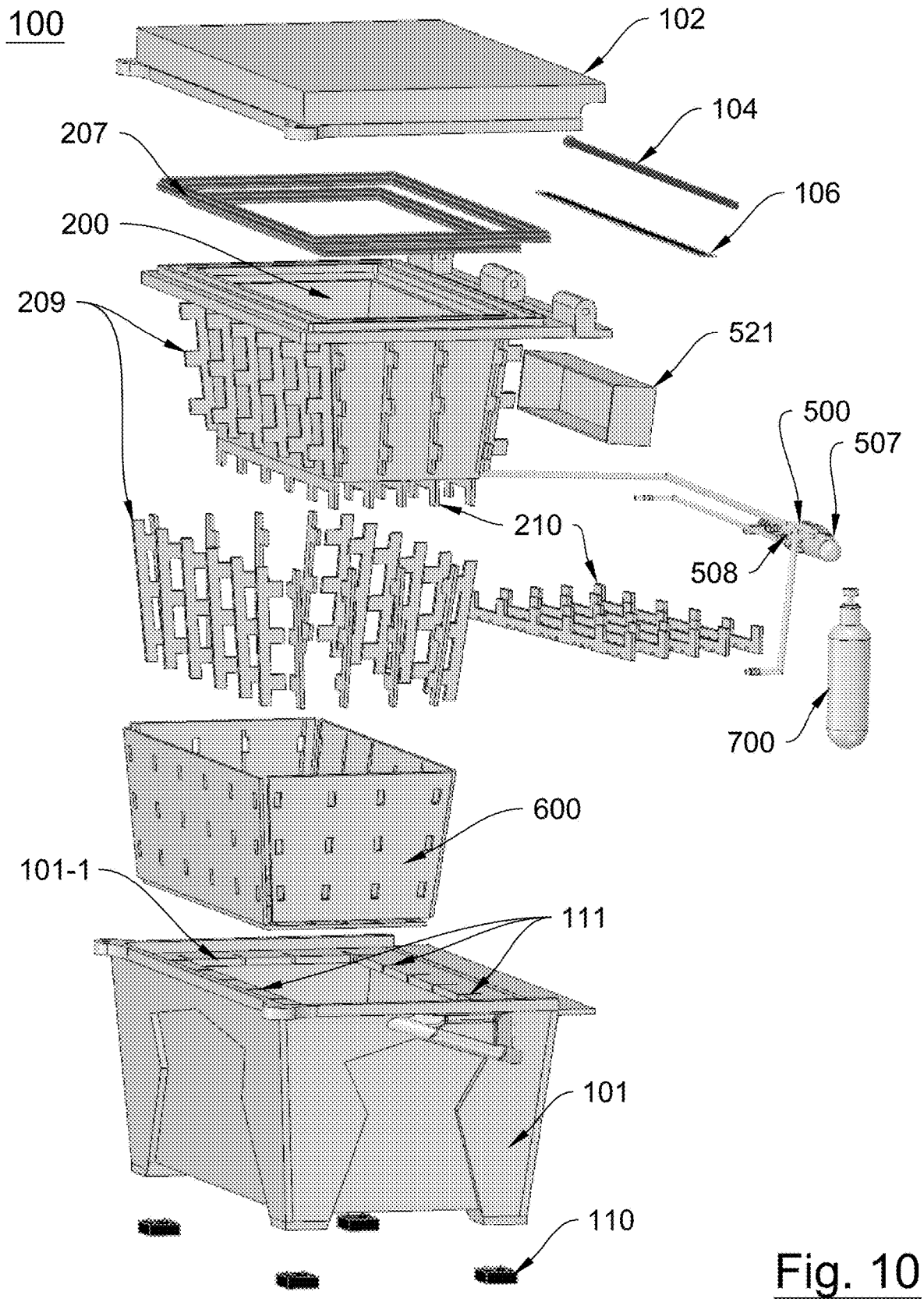
FIG. 10 is an exploded view of the refrigerated food storage box disclosed herein, showing various internal and external parts of the refrigerated food storage box.

FIG. 10 is an exploded perspective view from the front right side of the proposed ice chest cooler 100 and its major components. Describing from top to bottom, 102 is the hinged cover lid with insulation installed in the hollow space (not shown), 104 is the no rust hinge pin made out of aluminum or stainless steel. 106 is the rubber bumper strip to cushion the effects of lid hitting the auto stop strip. 207 are the inner and outer freezer type rubber gaskets while 200 is the inner food and beverage storage box having one part out of the two of the integrated standoffs 209 and 210 protruding out of the outside walls and floor. 500 and 507 are the Vortex tube and chilled air distribution manifold with supply lines 508 (or gas transmission lines 508) attached to 507. 600 is a block of plate type heat exchangers comprising of 601 (2), 602 (2) and 603 (1) five individual plate type heat exchangers, although any other type of heat exchanger can be used. 521 is the cover for the cooling components mounted on the back of the outer lower box 101 and 600 is the set of five plate type heat exchangers. 209 and 210 are a series of standalone mirror image of the integrated standoffs that are part of the inner box 200. 101 is the outer box housing majority of the components either on the inside or attached to it on the outside, 111 are a series of pass through slots in the flange 101-1 of the outer box 101 to accommodate the pass through of the vertical standoffs 209*s* as the inner box 200 is lowered in position into the outer box 101. 110 are non-slip rubber pads to stop the cooler from sliding when on the bed of a truck or deck of a boat. The two boxes 101 and 200 can be held in place using several methods, one, detachable compression fit or two, by permanent compression not detachable fit, using adhesive, using fasteners or by means of plastic rod welding to name just a few methods.

Figure 11:
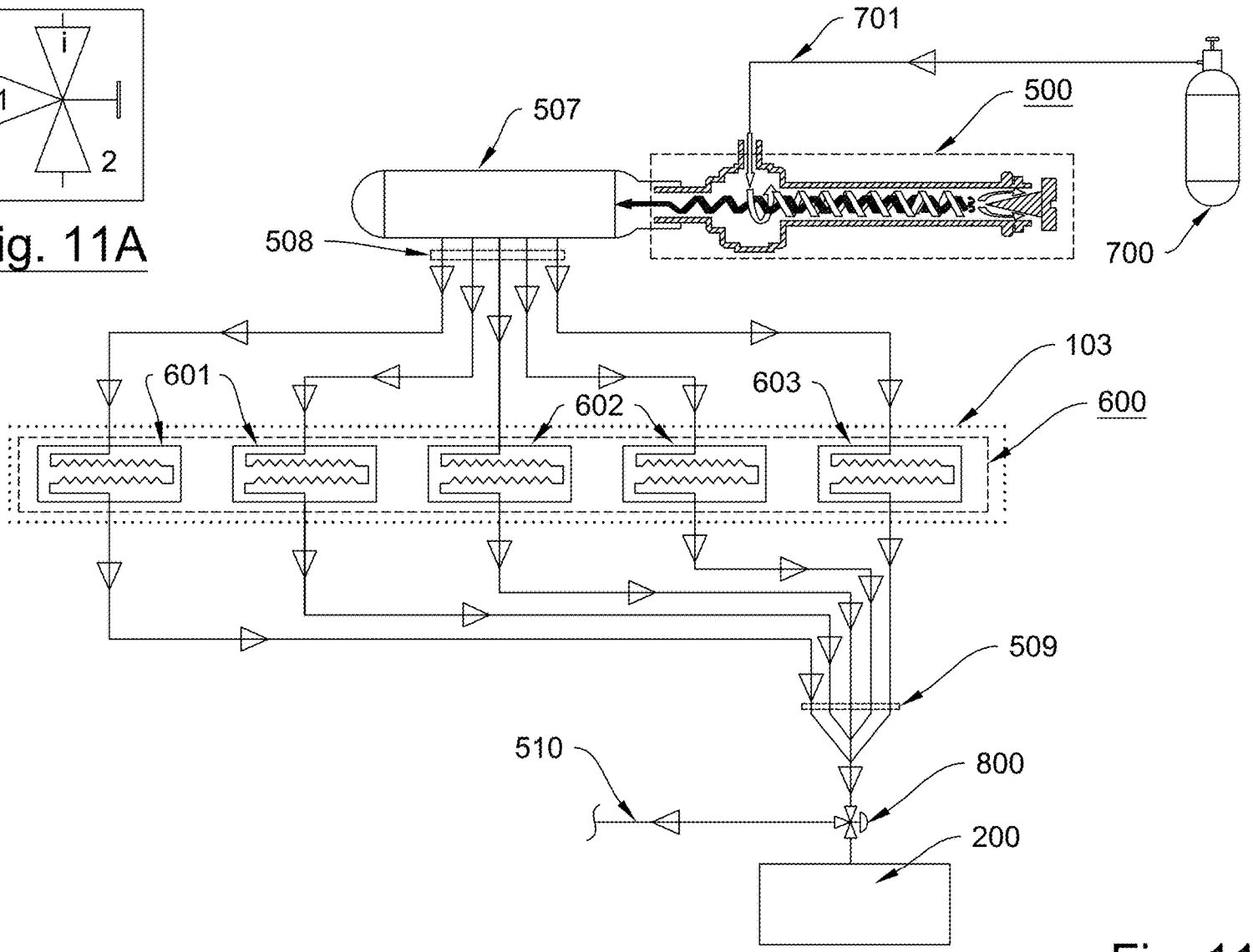
FIG. 11 is a schematic diagram showing the cooling system only of the refrigerated food storage box disclosed herein.

FIG. 11 is a schematic diagram of one of the preferred embodiment of the cooling system of the proposed refrigerated food storage box 100 or the ice chest cooler 100. Describing from top to bottom, 700 is a high pressure compressed air tank or any other source of compress gas to which one end of a flex supply line 701 is attached. Gas transmission or supply line 701's opposing end is attached to an inlet port of a vortex tube 500 while cold end of vortex tube 500 is attached to an air distribution manifold 507. Chilled air distribution manifold 507 can have a plurality of exhaust ports, five in this particular design to which one end of a set of five chilled air supply lines 508 are attached via nipples on 507. Other ends of the set of chilled are supply lines 508 are attached via nipples to inlet ports of each of the five individual heat exchangers 601 (2), 602 (2) and 603 (1) depicted as a block 600 located inside the thermal storage cavity 103. All five heat exchangers outlet ports are provided with nipples to which a set of five exit supply lines 509 are attached. Exit supply lines 509 merges into a single line (as shown, or into a manifold, not shown) and can be connected to a three-way valve 800, having an inlet port and two outlet ports with vales in each port that can be opened or closed. Spent chilled air still having reasonable cooling ability can either be vented into the atmosphere through spent gas line, or exit gas line 510, or to provide outdoor air conditioning for individual close to the ice chest cooler or be routed through line exit gas 510 into a detachable secondary insulated container to be used to cool the content of that container if desired or depending on the position of the two valves be exhausted into the food storage compartment 200 to provide additional forced air cooling. One of the valves can be completely opened while the other closed or opened at varying levels depending on the results desired by the operator.

Figure 11A:
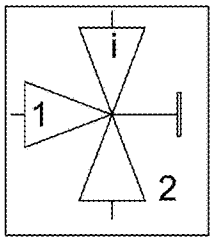
FIG. 11A is a close-up view of one of a 3-way valve showing one inlet port and 2 outlet ports.

FIG. 11*a* is an enlarged view of a 3-way valve, letter "i" depicts the inlet port which will remain open at all times while the Arabic numerical "1" and "2" depict exhaust ports 1 and 2. Valves in the exhaust ports 1 and 2 can be manually operated, solenoid type electrically or pneumatically operated to open and close at varying levels with commands according to a program from an electronic or pneumatic controller. One or the other valves 1 and 2 or both must remain open at all times during cooling cycle to allow escape of spend gases.

Figure 12:
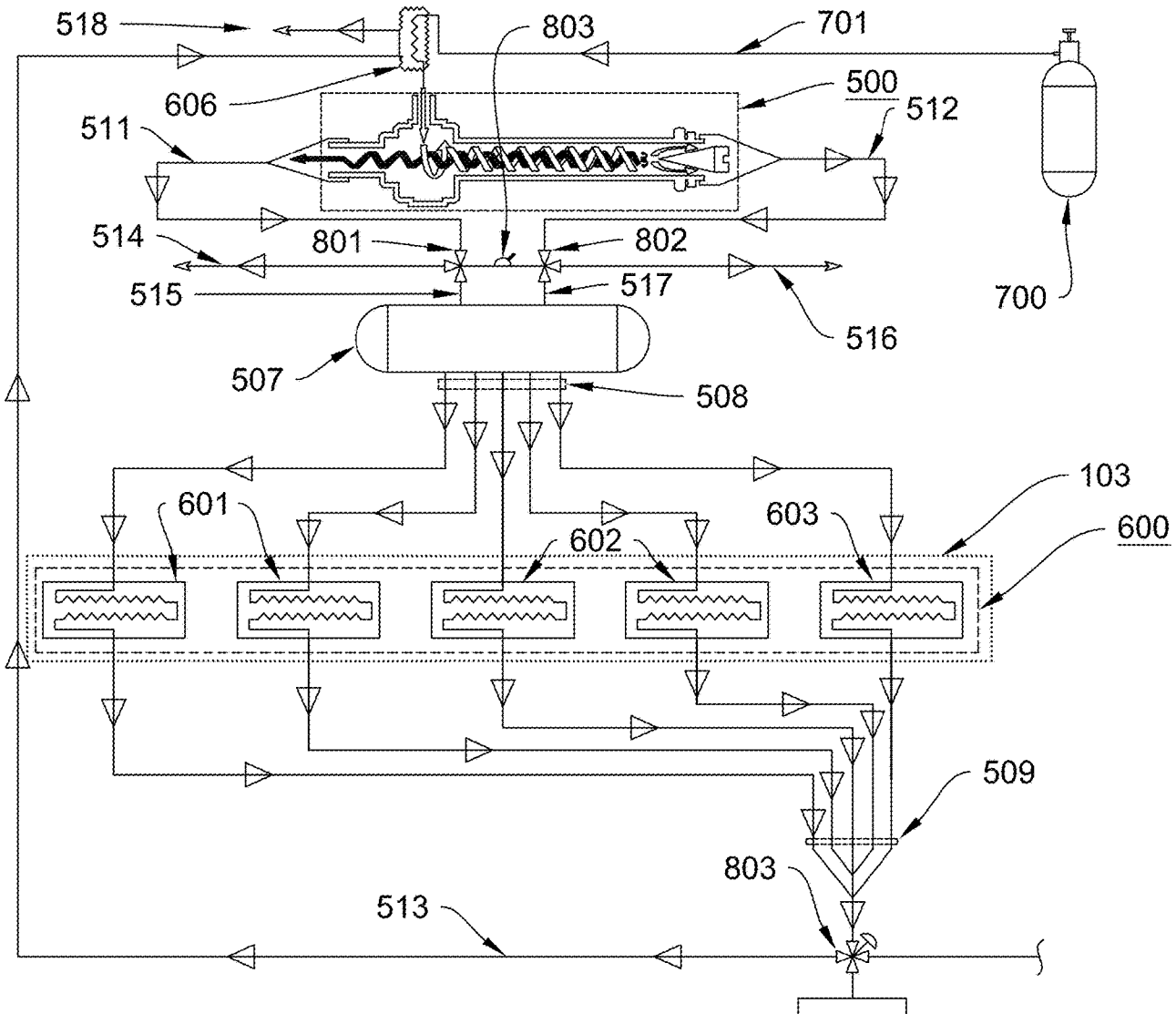
FIG. 12 is a schematic diagram showing how to switch from a refrigerated food storage box disclosed herein, to a hot box and various other performance enhancement that are possible, simply by turning on or off certain valves to re-route various temperature streams and to enhance performance.

FIG. 12 is a schematic diagram of a variation of FIG. 11, in this embodiment of the present invention ice chest cooler can be turned into a hot box with the simple flick of a switch configuring it to keep food and drinks hot as desired. With position of certain control valves piping hot air from the hot end of the vortex tube 500 into the system is accomplished in place of the chilled air from the cold end of vortex tube 500. Now looking at FIG. 12, 700 is high pressure air tank can supply compressed air through line 701 into the inlet port of the vortex tube 500 where hot and cold stream are exhausted from opposing ends. Transmission line 511's first end is attached to the cold end of 500 using a hermetically sealed shroud, while the opposing end is attached to a three ways valve 801 having one inlet and two outlet ports. First end of line 514 is attached to the first outlet port of 801 while first end of supply line 515 is attached to the other outlet port of three-way valve 801. The opposing end of the line 514 can be vented to the outside atmosphere or attached to a standalone insulated box to cool its contents or to provide outdoors air conditioning, while the opposing end of line 515 is attached to the distribution manifold 507.

Transmission line 512's first end it attached using hermetically sealed shroud to the hot end of vortex tube 500 while the opposing end of line 512 is attached to a three 3-way valve 802 having one inlet and two outlet ports identical to three-way valve 801. First end of line 516 is attached to the first outlet port of 802 while first end of line 517 is attached to the second outlet port of three-way valve 802. The opposing end of the line 516 can be vented to the outside atmosphere or attached to a standalone insulated box to keep its contents hot or any place where heat is needed, while the opposing end of line 517 is attached to the air distribution manifold 507.

Valves 801 and 802 can have an interconnected switching mechanism 803 that can channel either cold or the hot air into the manifold 507 at any given time by closing valve No. 2 in 801 while opening the same valve in 802 and vice versa. At any given time depending on the mode selected either cold or the hot air will be vented to the atmosphere or for alternate use by opening valve No. 1 on 801 and closing valve No. 1 on 802 or vice versa to run hot or cold stream through the air distribution manifold and other parts of the cooling/heating system like air distribution lines, heat exchangers etc.

A set of five gas transmission lines 508, connected to the gas distribution manifold 507 carry the cold or hot gases to each of the block 600 of five heat exchanger 601 (2), 602 (2) and 603 (1) where heat transfer can take place in the thermal storage cavity 103. Spent hot or cold air still having reasonable amount of cooling or heating ability can travel through a set of five exit lines 509 until they merge into a single line which can be connected to the inlet port of a four-way valve 804 having one inlet and three outlet ports. At any given time, the 3 outlet ports on 804 can be opened to varying levels but never all closed at the same time while the inlet port is always open. One of the outlet ports of four-way valve 804 can be hooked up to line 513 which is connected to a heat exchanger 606 the spent air transfers its heat or cooling through heat exchanger 606 and exits through line 518 into the atmosphere or channeled where needed. Spent air can be used to pre-cool or pre-heat the compressed gas being fed by line 701 into the inlet port of vortex tube 500. Depending on the hot or cold cycle being run lowering or increasing the temperature of the inlet gas can cause either a drop or increase of temperature of the hot and cold streams exiting the vortex tube 500, further increasing its efficiency since the temperature difference of a drop and increase by an average of 127° F. (71° C.) is somewhat dependent on the temperature of the inlet gas.

Figure 12A:
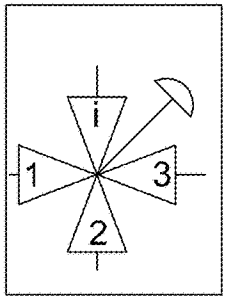
FIG. 12A is a close-up view of a 4-way valve showing one inlet port and 3 outlet ports.

FIG. 12A is an enlarged view of a 4-way valve. Letter "i" depicts the inlet port while the Arabic numerical "1", "2" and "3" depict exhaust ports 1, 2 and 3. Valves can be manually operated, solenoid type electrically operated or pneumatically operated. Note that the valve is for selecting one of hot air and cold air to be transferred from the vortex tube to the plate-type heat exchangers.

Figure 13:
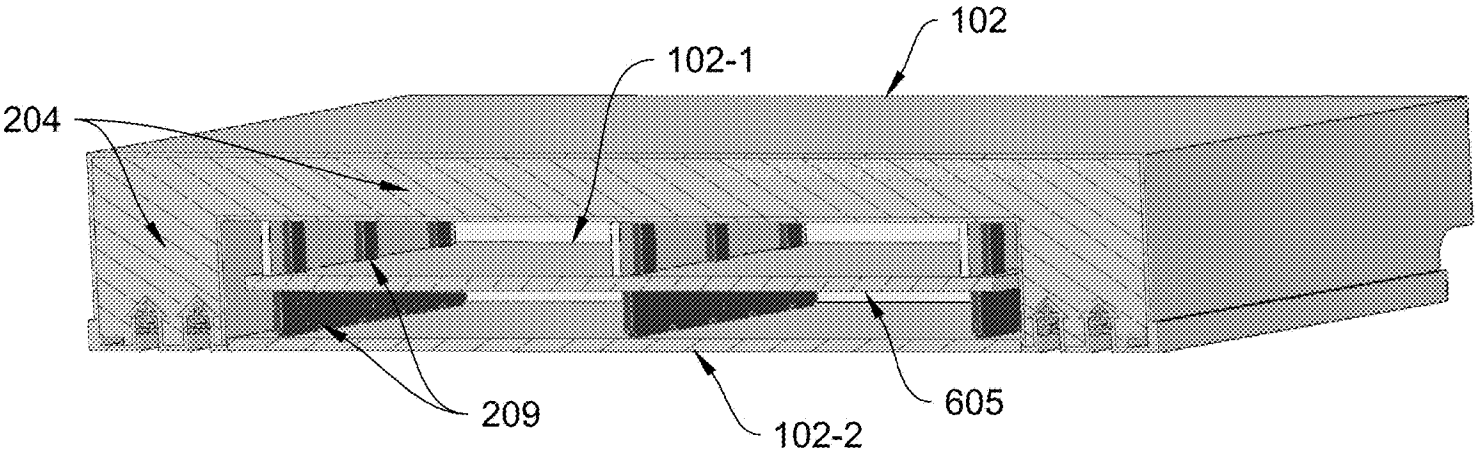
FIG. 13 is a front top perspective view of the lid of the refrigerated food storage box disclosed herein, in this embodiment the lid is also provided with a thermal storage cavity to enhance the performance of the refrigerated food storage box, various parts are shown.

FIG. 13 is a perspective cutaway view of hinged lid cover, or lid 102 of the ice chest cooler 100. In this embodiment lid 102 has a thermal storage cavity and insulation instead of insulation only. Now looking at FIG. 13, is cut away view of lid 102 shows insulation 204 installed in the top and outer areas of the lid double walled cavity. The lid 102's double walled cavity has a recessed area 102-1 toward the middle and inside of the lid 102 having a ceiling and walls on all four sides, wall extending down toward the floor at 90 degrees from a ceiling above. The recessed area 102-1 can form a hollow cavity with its lower end open. A lid cover 102-2 is installed completely closing off and sealing the cavity forming a water and air tight compartment 102-1. Lid cover 102-2 has built in integrated standoffs 209 to which plate type heat exchanger 605 can be attached, identical in arrangement and mounting method to the standoffs 209 and 210 and heat exchangers 601, 602 and 603 in the walls and floor of the cavity 103 between the lower box 101 and food storage box 200. A filler port not shown can be installed in the cavity lid 102-2 to pour in or pour out the thermal storage medium and other additives.

Figure 13B:
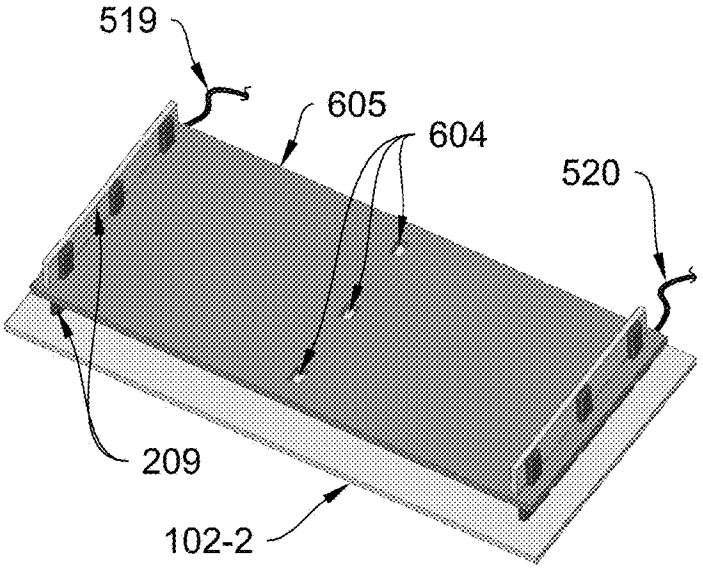
FIG. 13B is a front top perspective view of the internal components of the refrigerated food storage box disclosed herein, the depiction is the same as FIG. 13*a*, with the exception of one of the standoff being removed to show the slots in the heat exchanger.
Figure 13A:
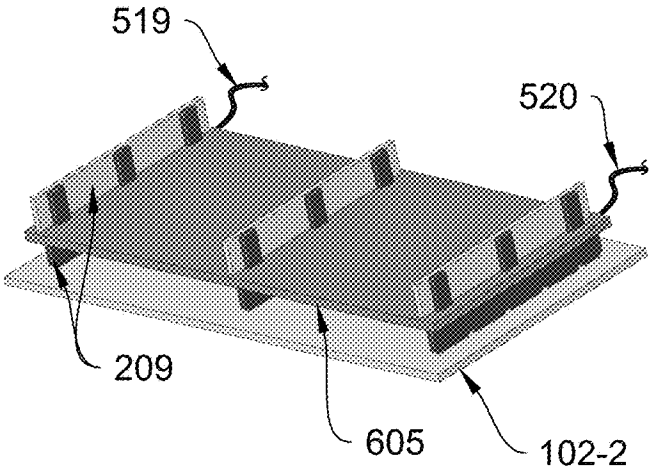
FIG. 13A is a front top perspective view of the internal components of the refrigerated food storage box disclosed herein, standoffs, cavity lid heat exchanger and heat exchanger inlet and out gas transmission lines are shown.

FIG. 13A is a perspective view of the lid 102 cavity cover 102-2, standoffs 209 and heat exchanger 605 that form cooling or heating system in the lid thermal storage cavity 102-1 of the lid 102 are shown. Inlet gas supply line 519 (another term for gas transmission line) and exhaust gas line 520 are attached to the heat exchanger 605.

FIG. 13B is an identical view as depicted in FIG. 13A, without one of the set of standoffs 209 to show the slots in heat exchanger 605. Inlet gas supply line 519 and exhaust gas line 520 are visible.

Figure 14:
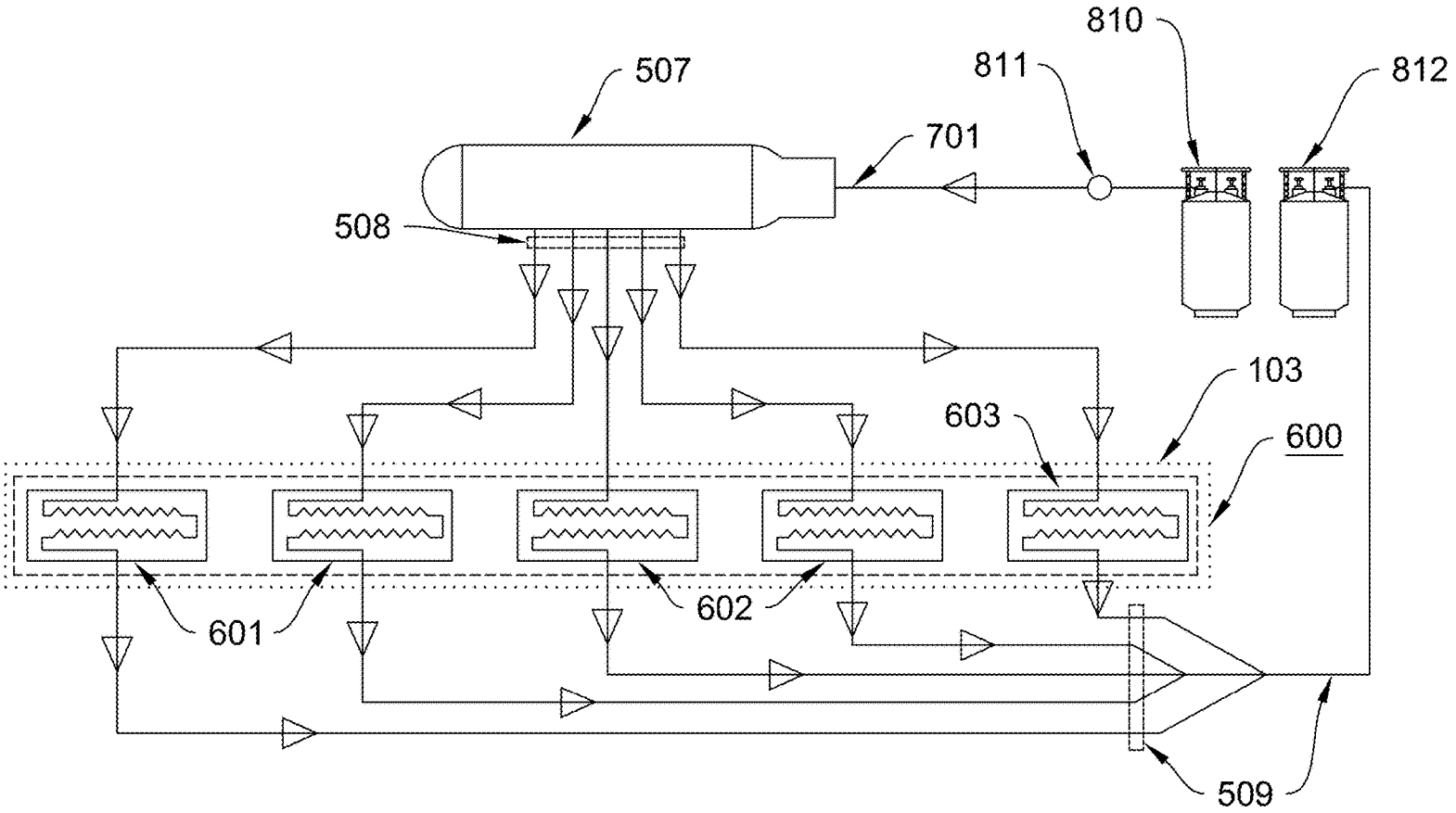
FIG. 14 is a schematic diagram of an embodiment of the present invention that uses liquid medium as a heat transfer fluid in place of as vortex tube and the super chilled gas produced by it to cool and freeze the thermal storage medium residing in the thermal storage cavity.

FIG. 14 is a schematic diagram of an embodiment of the refrigeration unit only, of the present invention ice chest cooler that utilizes a previously super cooled heat transfer fluid or liquefied gas like liquid nitrogen as a cooling agent. Now looking at FIG. 14, 810 is a cryogenic Dewar flask containing (in this case) liquid nitrogen, an outlet valve can be opened on the Dewar flask and pump 811 connected along the line 701 which is connected at one end to the outlet port on the Dewar flask and to a fluid distribution manifold 507 at the other. Heat transfer liquid can be circulated through a series supply lines 508 into 600 heat exchanger block having individual heat exchanger units 601 (2), 602(2) and 603 located inside the thermal storage cavity 103 inside the ice chest cooler 100. A series of return lines 509 carry the heat transfer fluid out of the heat exchangers plurality of lines merging into a single line connected to an inlet port of a second Dewar flask 812 allowing for recovery of the spent heat transfer fluid, still having significant cooling ability back into 812 to be used later as needed.

Figure 15:
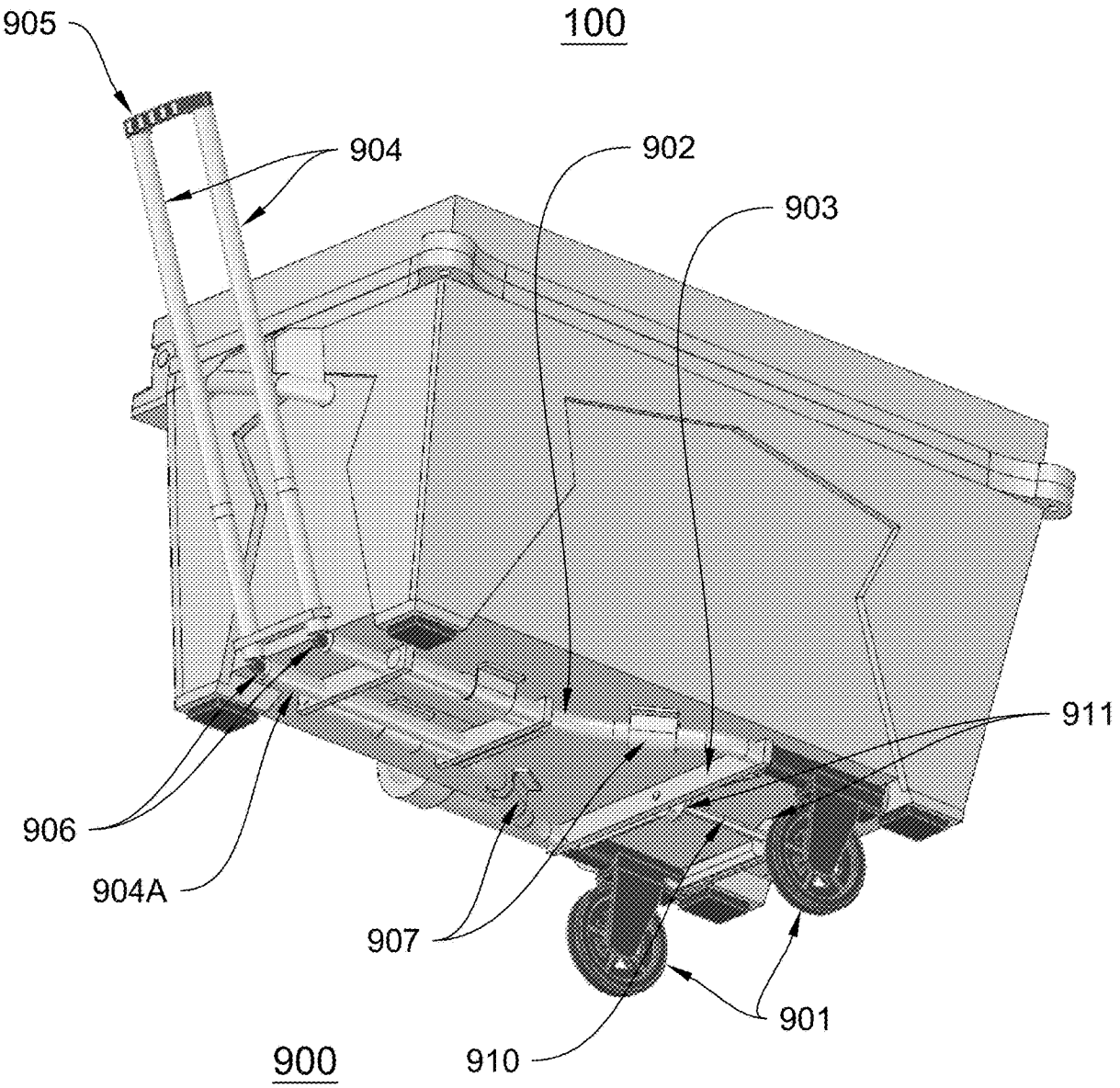
FIG. 15 is a front left side bottom perspective view of the proposed refrigerated food storage box disclosed herein, showing the various components of the under carriage namely, retractable pull handle, in extended position and various other parts as well as retractable wheels in deployed position.

Now looking at FIG. 15 various undercarriage components are shown as attached to the ice chest cooler/hot box 100. Under carriage 900 can be permanently or removable attached to the ices chest cooler/hot box via adhesive, clips or fasteners, for easy transporting eliminating the need for heavy lifting of the unit. 901 is a set of 2 retractable wheel assemblies, comprising of wheel and frame located at one end of an elongated bottom. 902 are a series of longitudinal frame members to which wheels 901 are slidably attached allowing for a free rotational movement of the wheels perpendicular to the longitudinal axis of the frame 902 by sliding the end of the frame 902 into the hole of the of the wheel frame 901 and installing a locking cross member 903 on either side utilizing bushings and spacers (not shown) on both sides to hold the wheels 901 in place. 903 are a series of cross members, in this arrangement 5 are shown to hold in place and support the longitudinal members 902 and 904, 904A. 904 are a set of 2 pull out hollow rods that have a handle 905 attached at one end while adjustable ratchet devices 906 are attached at the other end with stops so as to not be able to be pulled out of the end of the 904A second part of the folding mechanism. The pull out hollow rods can be adjusted in the to varying degrees from 0 degrees, parallel to the floor to vertical 90 to the floor due to ratchet action of 906. Hollow rods 904 can be made slightly smaller in diameter than the frame hollow rods 904A to allow 904 to easily slide into 904 at time of folding. 907 are a series of clips used to attach the undercarriage to the ice chest cooler/hot box (alternate term for the refrigerated food storage box). 910 is the drive shaft to which cam wheels 911 (one in the front and one in the back) are attached forming some parts of the wheels 901 retracting mechanism, to be discussed in detail in later Figures.

Figure 15A:
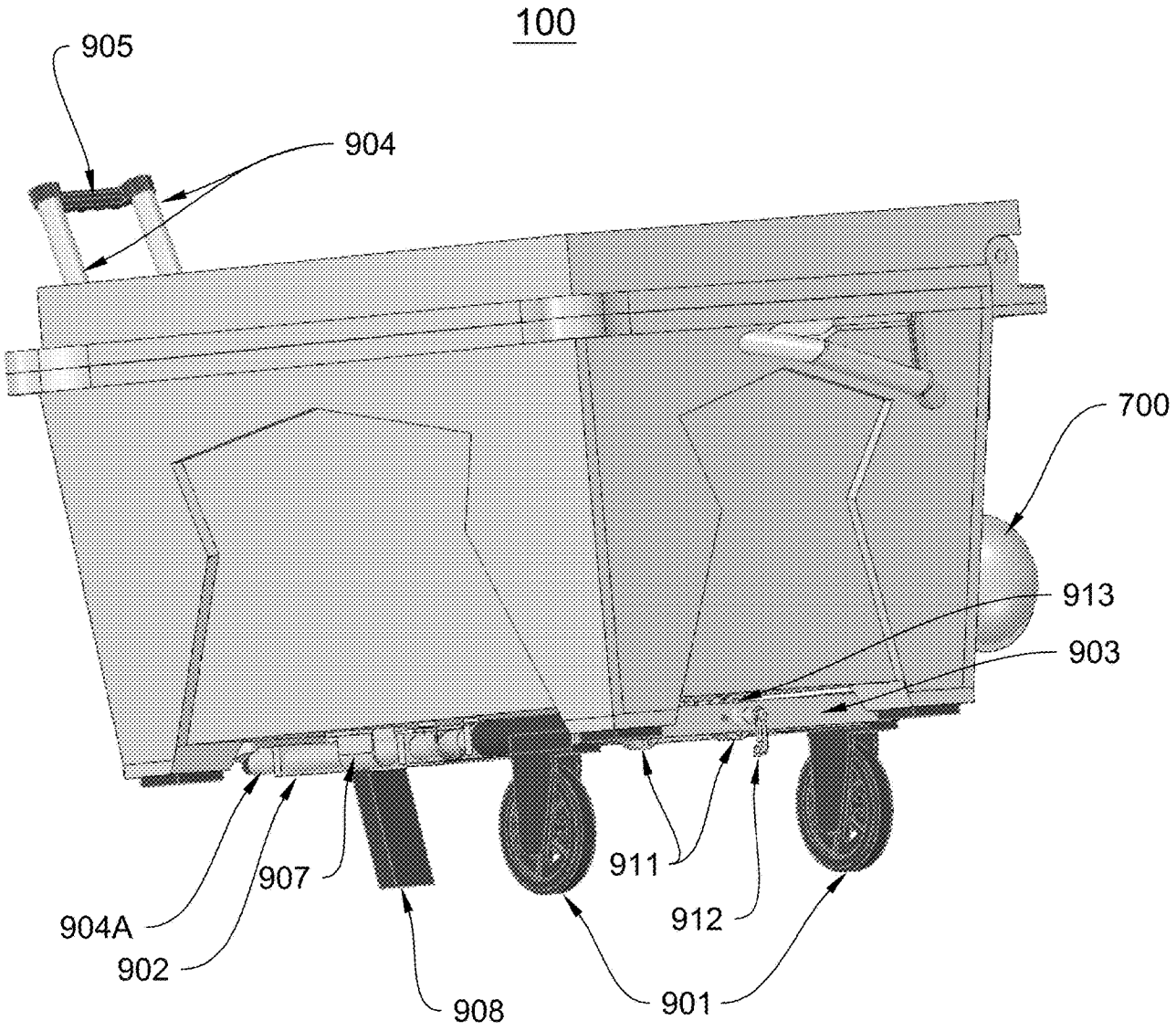
FIG. 15A is a front right side bottom view of the proposed refrigerated food storage box disclosed herein, showing pull handle and undercarriage components with retractable wheels and retractable front post in deployed position as well as showing the turn handle used to deploy or retract the wheels.

FIG. 15A depicts the same components of the undercarriage 900 of the ice chest cooler/hot box 100 as FIG. 15, with the exception of the wheels handle 912, not visible in previous figure, turning of which can retract or deploy the wheels and 908 a single retractable post shown that can stabilize the ice chest cooler/hot box in a horizontal generally level position when at rest with wheels and pull handle deployed, alternatively a single or double wheels (not shown) can be used in the front just like in the back. 913 are a series of 4 pins located on the back 911 cam mechanism to lock the cam in place by sliding into corresponding holes in cross member 903, to lock the wheels in deployed or retracted position. 700 a high-pressure air tank is partially visible.

Figure 15B:
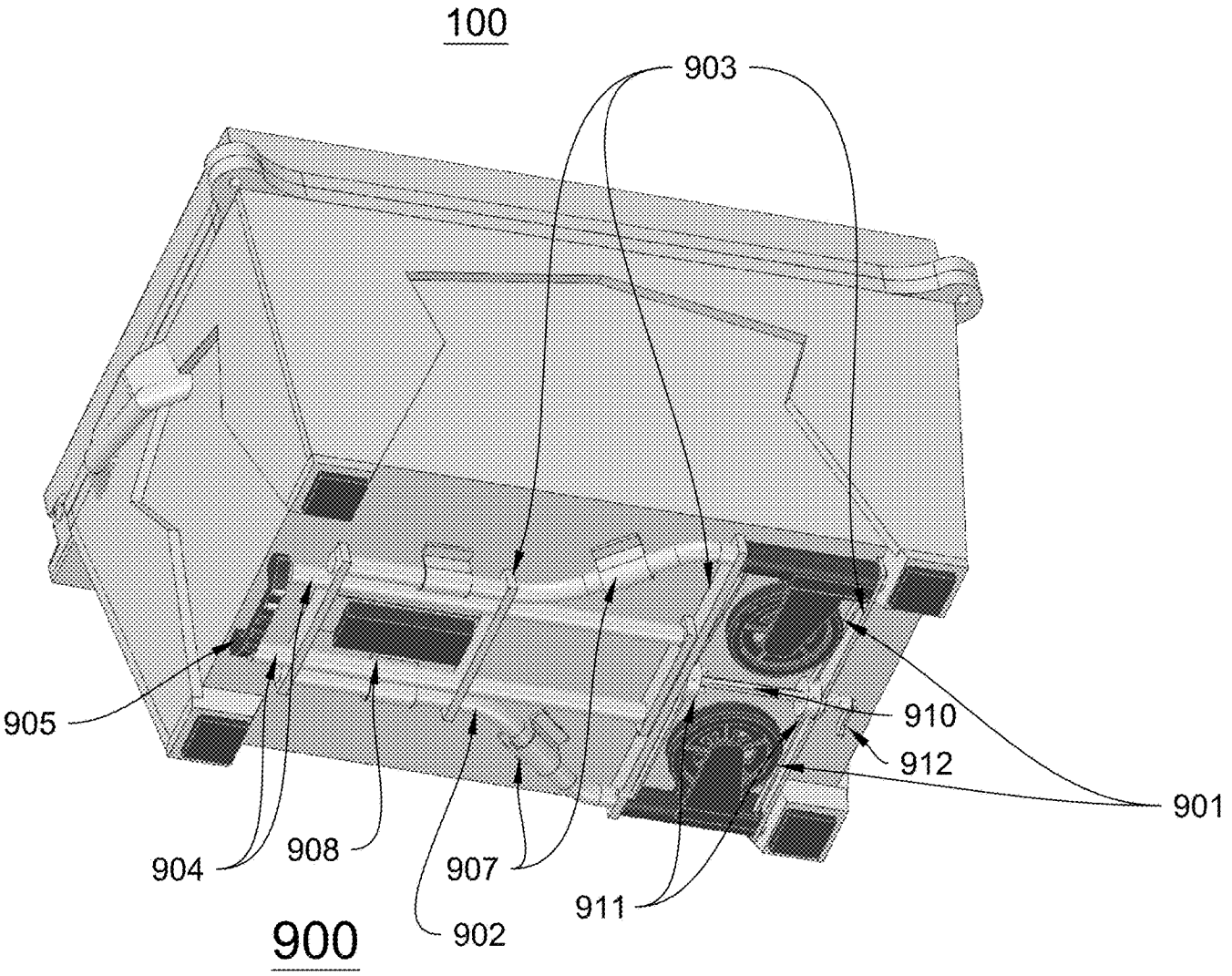
FIG. 15B is a front left bottom perspective view of the proposed refrigerated food storage box disclosed herein, in this view all components of the under carriage, namely, pull handle, wheels and the front post are shown in retracted position neatly tucked under the unit.

FIG. 15B shows all of the components of the undercarriage 900 of the ice chest cooler 100 as FIGS. 15 and 15A but in retracted position, neatly tucked under the ice chest cooler 100, undercarriage having a very low profile once folded in this case not exceeding 2 inches.

Figure 16:
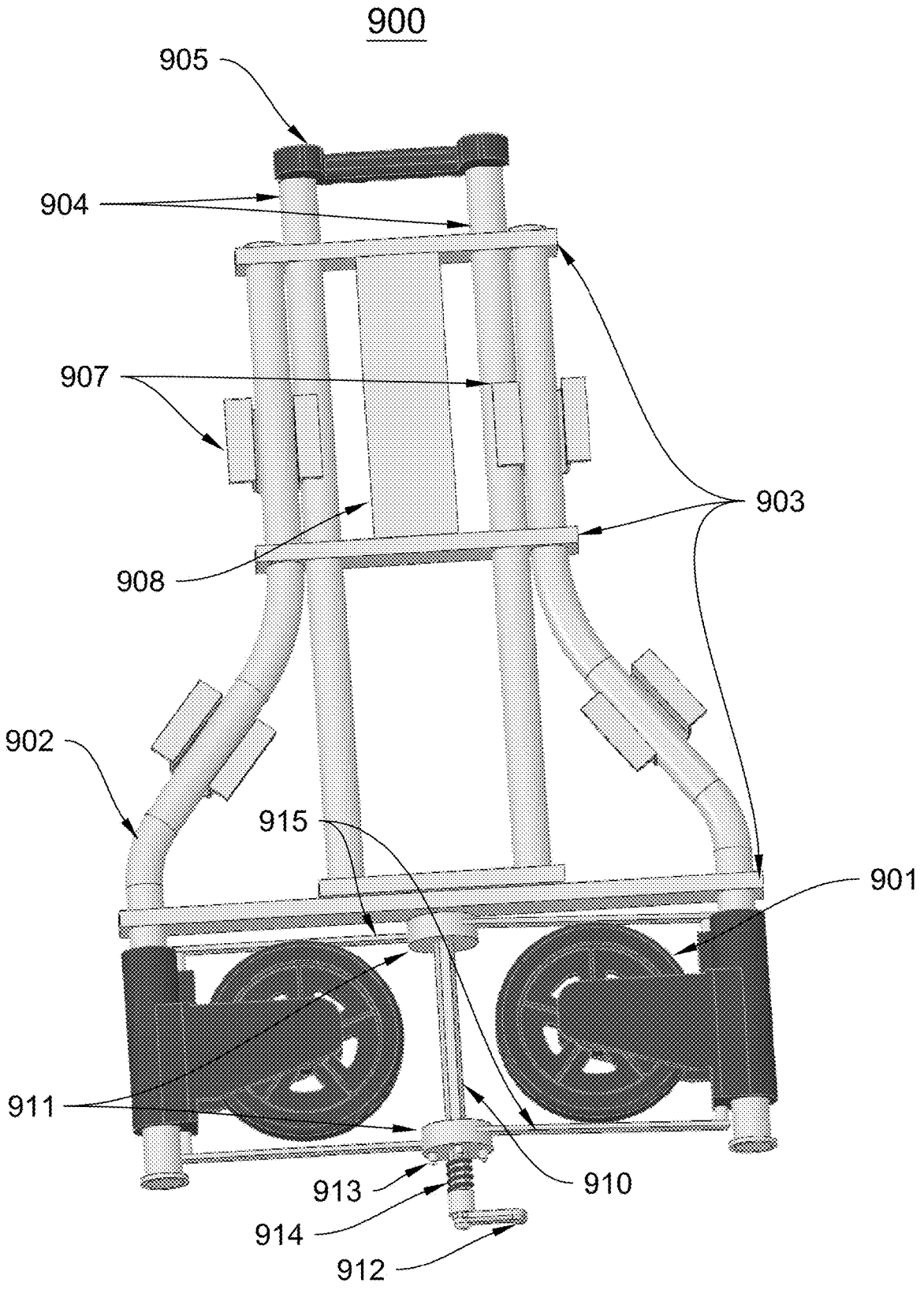
FIG. 16 is a right side back perspective view from the top of only the undercarriage of the proposed refrigerated food storage box disclosed herein. The pull handle wheels and the front post are shown in retracted position.

FIG. 16 provides a view from the top down showing only the undercarriage 900 of the ice chest cooler 100 is shown, with wheels pull handle 912 and retractable wheel assembly 901 in folded position. All components are same as previous views with the exception of for pins 913 shown coming out of back cam mechanism to which 915 push rods one on either side are attached jutting out in opposition direction, push rods 915 being attached to the cam mechanism with pin located off center so as to translate rotational motion of the cam 911 into linear motion of the push rods 915 in tangential push or pull manner depending on the direction of the rotation of the cam. Opposing end of push rods 915 being off centrally attached by pins to the right and left 901-wheel frame mounting so as to rotate the wheel frames once push rods apply either push or pull force as a result of wheel handle 912 being turned thereby imparting a rotational force on the cam 911 mechanism which turns rotational force into linear force on the wheel frame deploying or retracting the wheels. Four pins 913 in the cam mechanism 911 are located at North, East, South and West position of a compass, corresponding hole are present in the first cross bar to accommodate pin 913 into the holes as a mean to lock the cam into a static position preventing rotational movement of the cam 911 and longitudinal movement of the push rods 915 thereby, locking the wheels in either deployed or retracted position. To allow the wheels handle to remain in the desired position a spring 914 imparts a force on the wheels handle 912 in a direction away from the cross member 903 forcing to keep the pins 913 of the cam 911 to remain seated into the holes of cross member 903 thereby, locking any movement of the cam 911, the cam axel 910, the push rods 915 and the wheels handle 912 and finally the wheels 901. Wheels handle 912 can be pushed in to overcome the resistance of the spring 914 casing the cam 911 and the rod 910 to move in and away from the first cross member 903 thereby causing pins 913 to travel out of the holes in 903, once cleared of the holes the pins 913 and cam 911 can freely turn at this point the handle 912 can be turned causing the cam and pins to rotate through 90 degrees imparting the desired lateral force via push rods 915 to deploy open by turning the wheels 901. At this point the inward force on the wheels pull handle can be released causing the spring 914 to push back handle 912 causing the pins 913 to travel back into holes of the first cross member 903 locking the movement of the entire wheels deployment or retraction system.

Figure 16A:
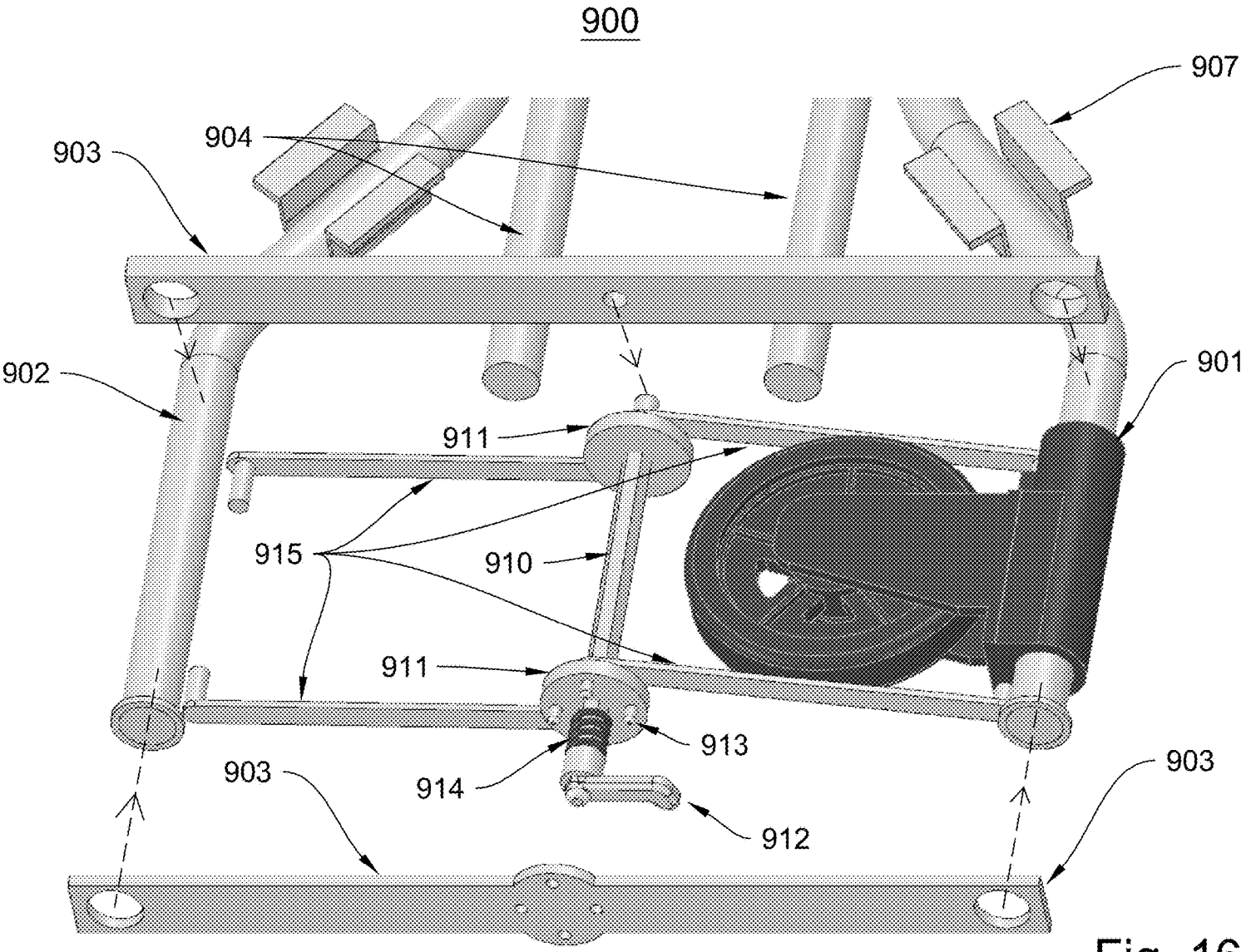
FIG. 16A is a right side back perspective view from the top of the undercarriage of the proposed refrigerated food storage box disclosed herein, showing a close up of the components to deploy and retract the wheels.

FIG. 16A is a close-up view of the wheels from the back top looking down at a 45-degree angle of the proposed ice chest cooler wheels retracting mechanism. Left wheel 901 has been removed and the first and second cross members 903 have been move out of the way to afford a better view of some of the components whose view they were obstructing, namely the pins 913 of the cam 911 at the end and at right angles of the push rods 915 that engage the wheels frame on the outside circumference to allow the transition of lateral force into a rotations force imparted on the wheel frames.

Figure 16B:
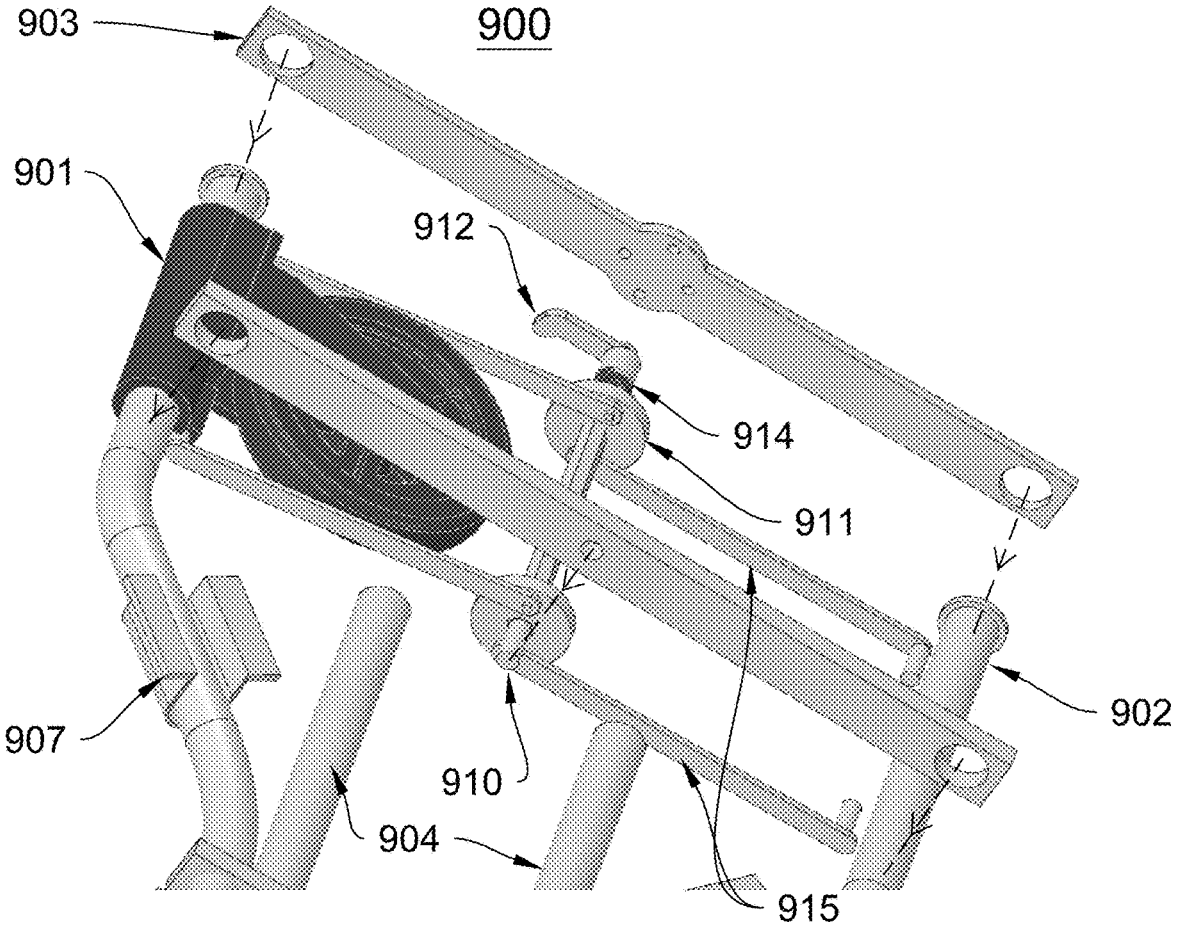
FIG. 16B is a right-side front top perspective view of the undercarriage of the proposed refrigerated food storage box disclosed herein, showing an opposite perspective view as FIG. 16A of the components to deploy and retract the wheels.

FIG. 16B is a close-up view from above and front right sides (opposite direction as FIG. 16A), looking down at approximately 60 degrees to show various components of the wheels and the retracting system. This view depicts most of the same components as FIGS. 16 and 16A, with the exception of showing push rod 915 attachment pins to the cam 911 and pins at the end of the push rods 915 being attached to the wheel frame, one wheel removed to show the pins at end of push rods 915. Additionally, rounded end of the cam axel 910 that seats into the hole in the second frame member 903 is clearly visible allowing for free rotation of the rod 910 when wheels handle is turned thereby turning the cam axel 910.

Figure 16C:
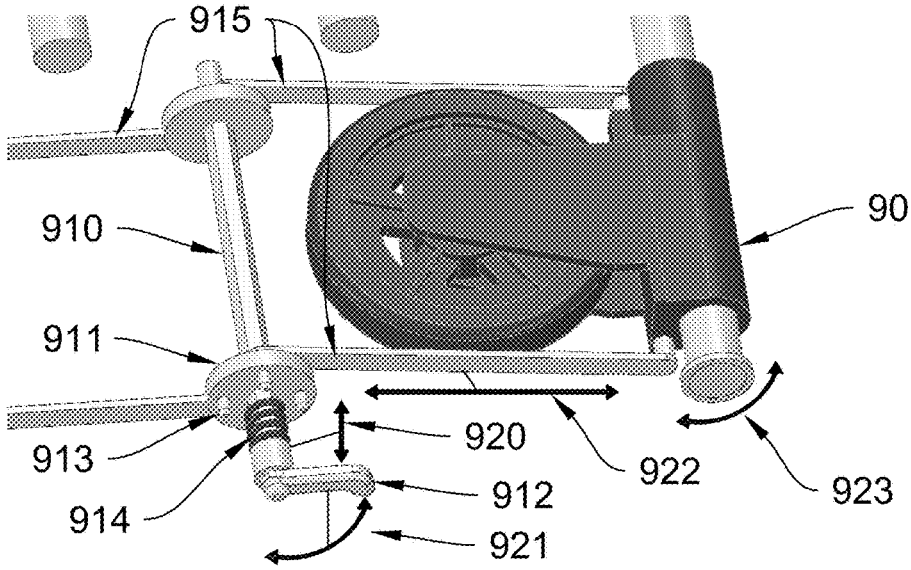
FIG. 16C is a close up right side back top view of the mechanism to deploy and retract the wheels of the proposed refrigerated food storage box disclosed herein.

FIG. 16C is a close-up view of the wheel folding mechanism showing various parts as in FIG. 16B, 4 arrows are show depicting the direction and sequence of movement to extend or retract the wheels. 920 is an arrow depicting push of the wheels handle, against the force exerted by spring 914 to cause movement of cam 911 to disengage the pins 913 on the cam 911 from the holes in the first cross brace 903 (now shown). Once pins 913 are clear of holes on first cross member 903 the handle 912 can be rotated clock wise 90 degrees as depicted by arrow 921, the rotation movement of 912 and 911 can push the push rod 915 in direction as depicted by arrow 922 laterally away from the cam 911 thereby exerting a force on the wheel bracket 901 causing it to rotate in a counter clock wise direction as depicted by arrow 923 about the longitudinal axis of the hollow frame the wheel bracket 901 is mounted on causing it to be deployed. To retract the wheels all the previous steps can be reversed as shown by double ended arrows 920, 921, 922 and 923.

Figure 17A:
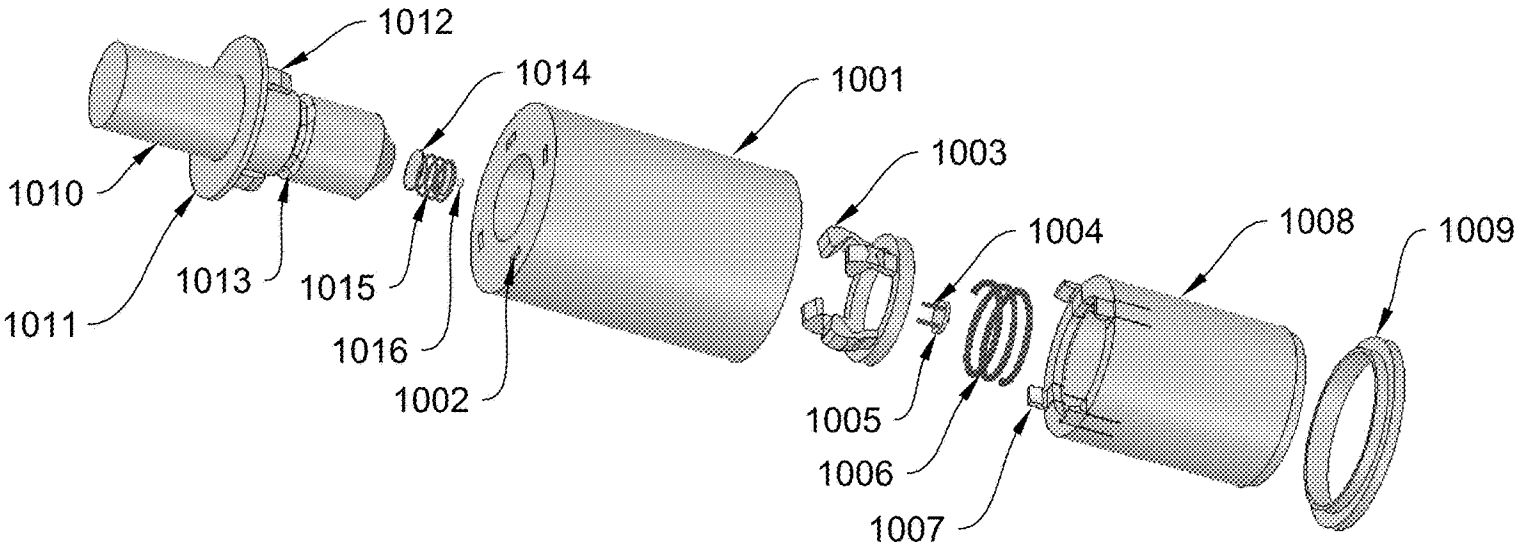
FIG. 17A is an exploded view of quick engage and release locking mechanism used in a preferred embodiment of the proposed refrigerated food storage box disclosed herein, facilitating quick lock and quick release of the lid.

FIG. 17A is a close up exploded exterior view of the quick engage and quick release locking mechanism of the ice chest cooler/hot box for locking and unlocking the hinged lid cover with the rest of the refrigerated food storage box. Now looking at FIG. 17A, external view of various parts is shown where 1001 is the main cylindrical housing of the lock part that can be attached to the body of the ice chest cooler 101, 1002 are pass through slots, four totals, to allow pins 1012 attached to a flange 1011 of the male member lid member 1010 that resides in the lid of the cooler to enter slots 1002. 1013 is a double-sided ramp shaped grove in the male lid shaft 1010, 1014 is a flange attached to a shaft 1016, a spring 1015 is slid over the shaft 1016. Spring 1015's one end stops as it comes in contact with flange 1014. A washer is slid over the shaft to keep the spring in between the flange 1014 and washer with the shaft 1016 running through the spring. 1003 is a retainer member in the form of a ring with four flexible truncated-cone-shaped formations/fingers mounted on the ring extending outwardly, the four fingers having limited ability to flex radially towards the center as well as away from the center of the ring, the ring of 1003 can slide over the inside cylinder of the main cylindrical housing 1001 and can be locked into place to prevent backward movement of the ring by ridge 1017. 1004 are a set of 2 retaining screws while 1005 is a locking washer, 1006 is a spring to impart force between the outer main cylindrical body 1001 and the inner sliding cylindrical body 1008 to keep it in the locked position, 1009 is a locking ring to prevent the internal sliding cylinder 1008 from sliding out of the main cylindrical body 1001. 1008 the internal sliding cylindrical housing having four flexible grappling hook pins 1007 in recessed slits 1018 (see FIG. 17B) cut into the internal sliding cylindrical housing 1008. When force is applied by fingers of the operator on the bottom of 1008 the upwards force can cause the inner cylinder to be pushed upwards releasing the force imparted on 1003 fingers by the flange of 1007 allowing them to release the hold on 1013, which under locked position forces 1003 into the grove 1013 thereby locking 1010 male member into place as the lid is opened and ramp shaped groves 1013 push outwards the fingers 1003 releasing the hold on the grove 1013 of the male member 1010. Eventually upwards travel can cause the grappling hooks 1007 to engage the flange of 1002 locking the internal sliding member into place. At this point spring 1015 can expand pushing the flange 1014 against the male member 1010 forcing it to push out of the main cylindrical housing causing the lid to open.

Figure 17B:
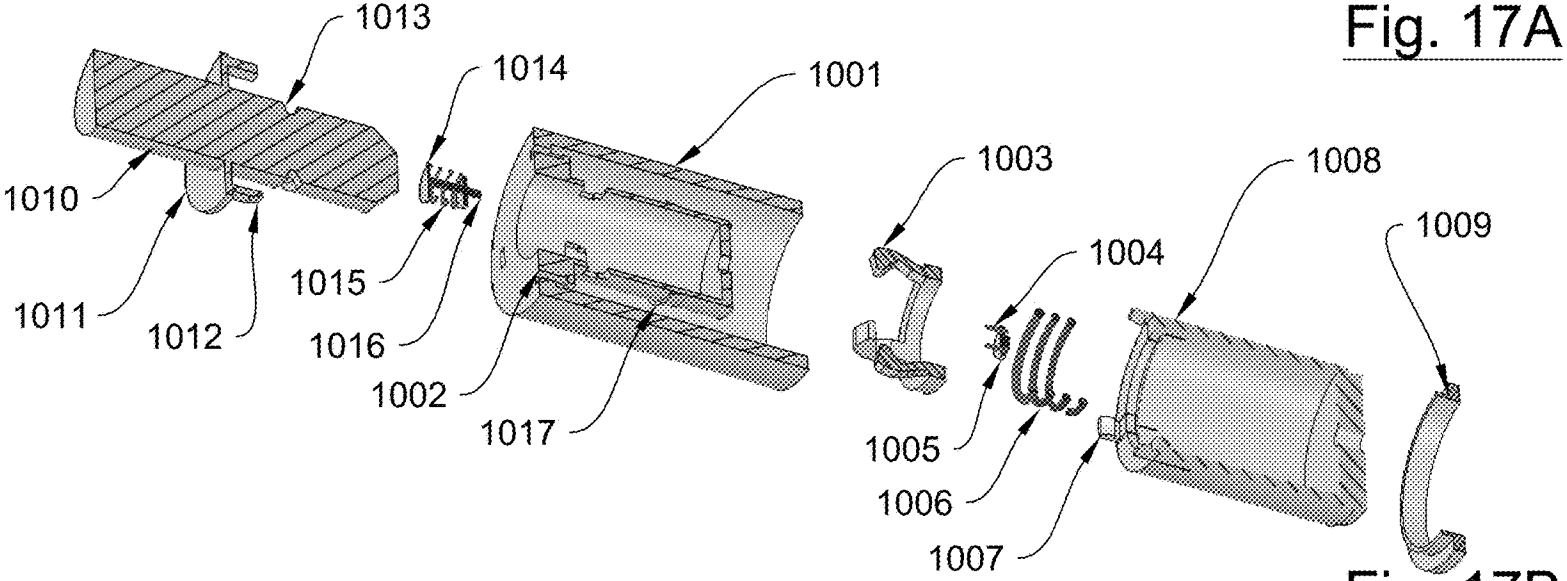
FIG. 17B is a cutaway exploded view of the quick engage and release locking mechanism used in a preferred embodiment of the proposed refrigerated food storage disclosed her in, showing internal parts to facilitate quick lock and quick release of the lid.

FIG. 17B is a cutaway view of FIG. 17A all parts are the same as the previous Fig. except double walled cylinder's 1001's insides are shown as well as the retaining ring 1003 locking ride 1017 visible.

Figure 17C:
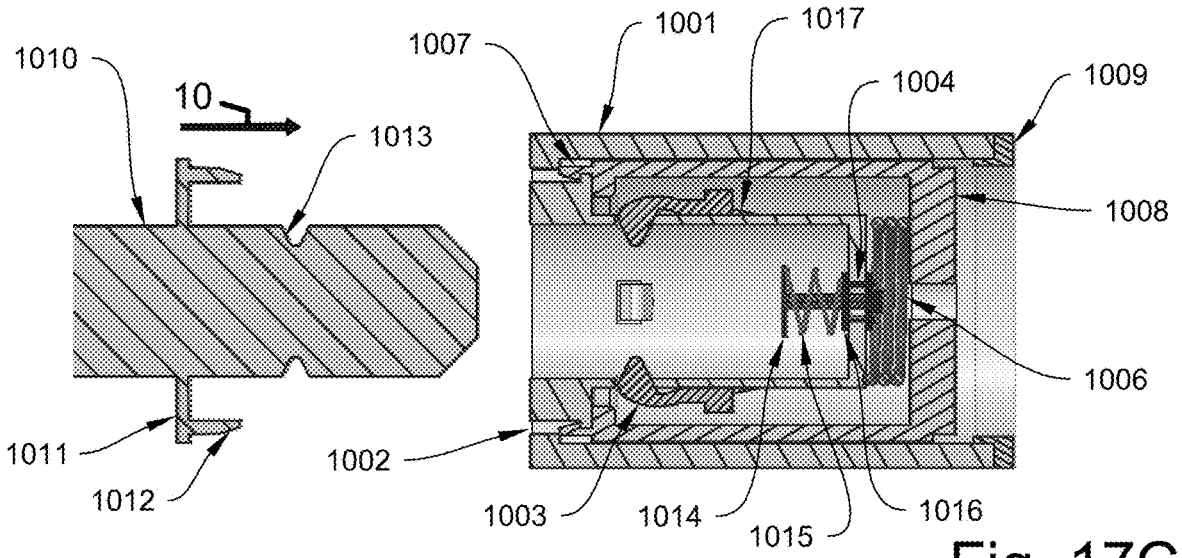
FIG. 17C is an exploded view of certain kind of a quick engage and release locking mechanism used in a preferred embodiment of the proposed refrigerated food storage box/hot box disclosed herein, facilitating quick lock and quick release of the lid, this view shows the internal position of various parts when the lid in an open position.

FIG. 17C is a cutaway side view of the quick lock and quick release mechanism of the ice chest cooler/hot box in an open lid position, where the main male member 1010 and female cylindrical parts are shown in a separated position, large arrow 10 depicting direction of travel of the lid and the male member shaft 1010. The internal sliding cylindrical mechanism 1008 is in full forward position locking the grappling hooks 1007 into the flange of the slots 1002. Spring mechanism to pop open the lid are shown in deployed position where spring 1015 is fully extended pushing the flange 1014 full forward, washer mounted over the shaft 1016 on the internal side of the bottom hole of 1001 can be seen attached to washed 1005 on the outer side of the bottom hole of 1001 with screws 1004 passing through 1005 into 1001 and finally into 1016 holding the two washers firmly in place. A retaining nut is attached at the end of the shaft 1016 at the opposing end of the shaft from the flange 1014 to prevent the shaft end from traveling past the washer 1005 when spring 1015 is fully extended. Spring 1006 is shown in fully compressed position due to full forward and locked position of the inner cylinder 1008 causing the inner cylinder flange/grappling hooks 1007 to release pressure on the retainer fingers 1003 thereby allowing movement in an outwardly direction as the ramp at the end of the male member 1010 pushes on the retainer fingers 1003 as it enters the cylinder housing hole.

Figure 17D:
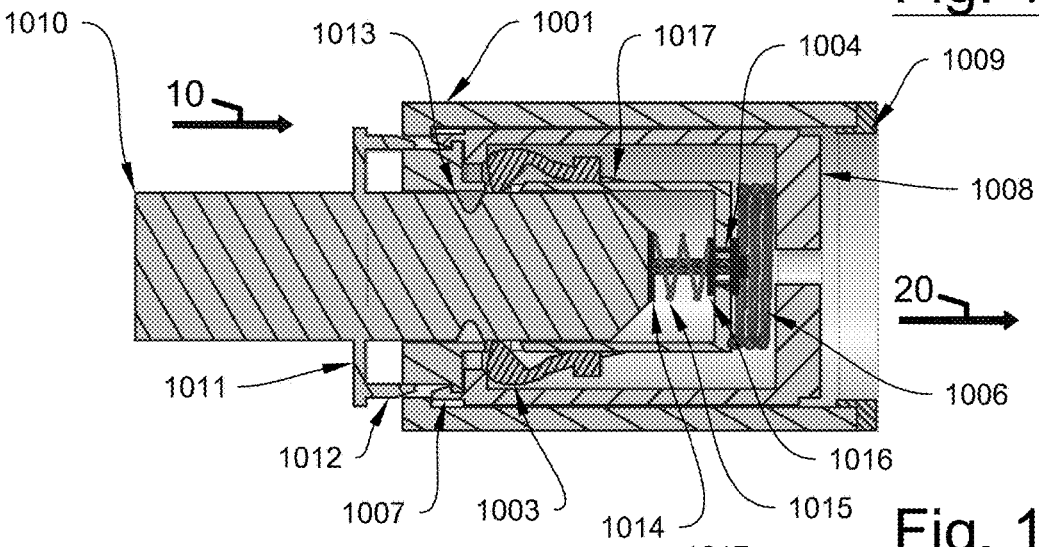
FIG. 17D is an exploded view of certain kind of a quick engage and release locking mechanism used in a preferred embodiment of the proposed refrigerated food storage box disclosed herein, facilitating quick lock and quick release of the lid, this view shows the internal position of various parts as the lid is closing but not yet locked.

FIG. 17D is the same as FIG. 17C, except the lid in this view is being closed and about to be locked into place, the pins 1012 of the male member 1010, whose direction of travel is depicted by large arrow 10 are entering the slots 1002 as the male member 1010 enters into the main hole of 1001 cylindrical housing to eventually push the grappling hooks outward thereby clearing the internal flange of the slots 1002, as the grappling hooks are cleared the tension of the spring 1006 can cause the inner sliding cylinder 1008 to slide back or down (when installed in the cooler in a vertical orientation) as depicted by large arrow 20 causing the locking fingers 1003 to be pushed into the grove 1013 by the internal flange of 1007 locking the male member 1010 firmly in place in a locked position. As the male member completes its travel into the main hole of the cylindrical housing 1001, flange and spring mechanism 1014, 1015 depressed into fully closed position, ready to push the lid open the next time 1008 internal sliding cylinder is pushed up releasing the forced imparted on the locking fingers to spring open the lid.

Figure 17E:
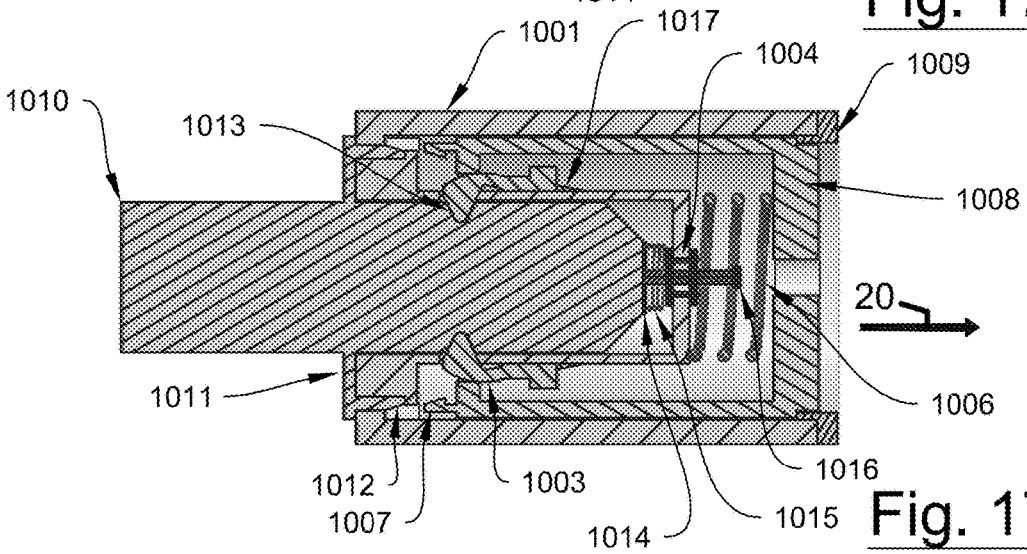
FIG. 17E is an exploded view of certain kind of a quick engage and release locking mechanism used in a preferred embodiment of the proposed refrigerated food storage box disclosed herein, facilitating quick lock and quick release of the lid, this view shows the internal position of various parts when lid is closed and locked.

FIG. 17E is same as FIGS. 17C and D, except the quick lock and quick release lock is shown in fully engaged position. Male member 1010 and pins 1012 are fully inserted into the hole of the cylindrical housing 1001. Internal sliding cylinder 1008 is shown fully pushed back by the spring 1006 apply pressure against the internal walls of 1001 and 1008 forcing the inner cylinder 1008 to move fully back as depicted by large arrow 20, causing flange 1007 just behind the grappling hooks and slits to apply pressure on locking fingers 1003 to be held in locked position.

Figure 17F:
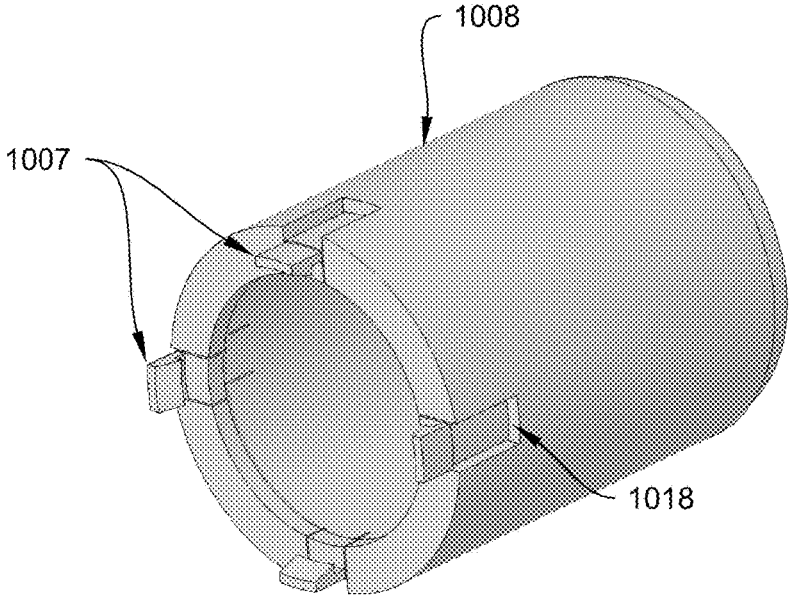
FIG. 17F is a close-up view of internal sliding cylinder mechanism of the a quick engage and release locking mechanism used in a preferred embodiment of the proposed refrigerated food storage box disclosed herein, facilitating quick lock and quick release of the lid, this view shows the internal only the internal sliding cylinder with its lock tabs and slots that engage with the outer cylinder to lock it in place.

FIG. 17F is a close up view of the inner sliding cylinder 1008 showing the grappling hooks 1007 and the recessed slits 1018 to allow the grappling hooks sufficient outward travel between the inner walls of 1001 and the outer wall of 1008 when pins 1012 of the male member 1010 push on the grappling hooks 1007 to cause outward travel there by clearing the flange of the internal slots 1002 releasing the hold and allowing travel of the 1008 to a position to facilitate locking of the male member 1010.

Figure 17G:
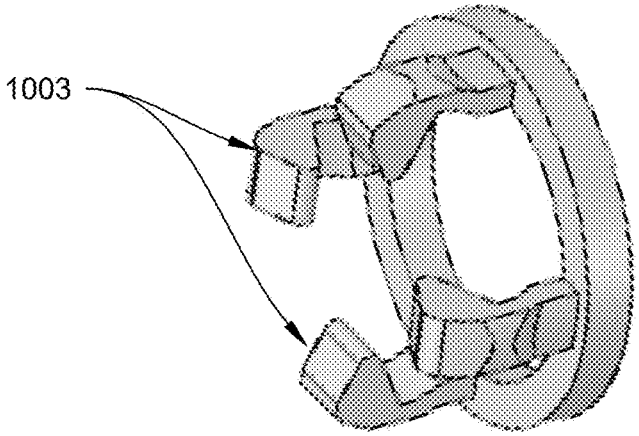
FIG. 17G is a close-up view of a part responsible for locking the lid into place of a preferred embodiment of a locking mechanism of the proposed refrigerated food storage box disclosed herein.

FIG. 17G is a close up of a retaining member 1003 showing it's four fingers used to engage the grove 1013 of the male member 1010 to firmly lock the lid of the ice chest cooler/hot box.

Figure 17H:
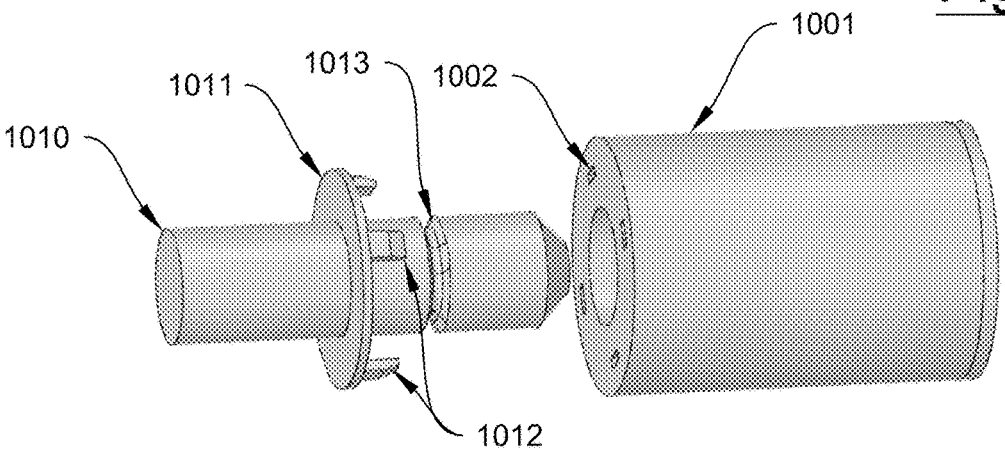
FIG. 17H is a close-up view of the locking mechanism of the preferred embodiment of the proposed invention refrigerated food storage box disclosed herein showing the two parts in a separated position.

FIG. 17H is an exterior close up of the main cylinder unit 1001 of the quick lock and quick release locking mechanism and male member 1010 in separated position.

Figure 17I:
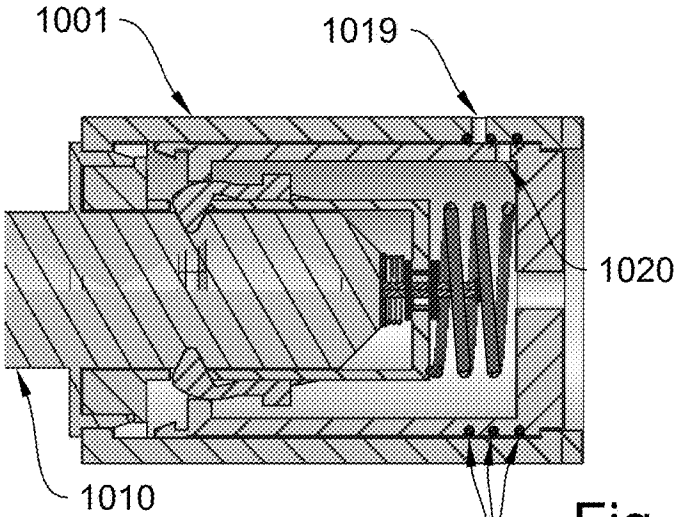
FIG. 17I is a cutaway view of the preferred embodiment of the proposed invention refrigerated food storage box disclosed herein, showing quick lock and quick release locking mechanism with build in air lock release holes in a closed position.

In FIG. 17I, is a cutaway view of the quick lock and release mechanism with built in air lock release holes shown in closed position (misaligned), main cylindrical body 1001 of the locking mechanism can have a tiny air relief hole 1019 which is connected on the cooler body side via a hole or an air tube to the inside of the food storage cavity 200 of the ice chest cooler/hot box 100. A same size hole 1020 is present in the sliding inner cylinder 1008 that is misaligned or offset to the hole 1019 of the main cylinder body. A series to three rubber gaskets 1021 are installed in groves of the outer circumference of the sliding inner cylinder 1008, one gasket each side of the air relief hole 1020 are installed while the third gasket is positioned adjacent the furthest part of the hole 1019 in the main cylindrical body, the three gaskets pressing against the inner walls of the main cylindrical housing 1001 forming two chambers that are hermitically sealed, cutting off holes 1019 and the cavity 200 from the outside atmosphere while the hole 1020 is cut off from the inside food storage cavity 200 when the lid is closed and locked.

Figure 17J:
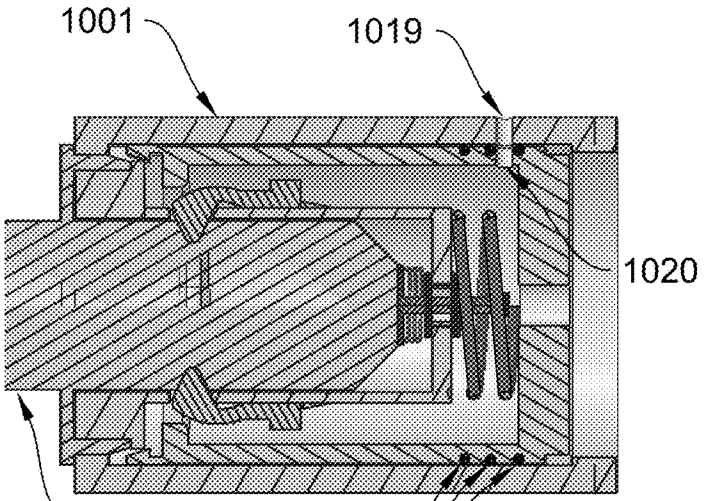
FIG. 17J is a cutaway view of the preferred embodiment of the proposed invention refrigerated food storage box disclosed herein, showing quick lock and quick release locking mechanism with build in air lock release holes in an open position.

FIG. 17J, shows a cut away view of the quick lock and release locking mechanism with the air relief holes 1019 and 1020 in an aligned position after the bottom of the sliding inner cylinder is pushed in by hand causing the cylinder and the attached rubber gaskets to travel up aligning the holes 1019 and 1020 releasing the pressure exerted by the flange of the grappling hooks 1007 on the retainer ring fingers 1003 causing them to be push out releasing the hold on the grove 1013 of the male member 1010. Alignment of the holes 1019 and 1020 can break the air lock developed inside the food storage cavity 200 of the ice chest cooler/hot box by giving the air inside and outside a through passage facilitating pressure equalization between the food storage cavity 200 of the ice chest cooler 100 and the outside atmosphere thereby, releasing the vacuum air lock created inside the food storage cavity facilitating effortless opening of the lid 102.

Figure 18A:
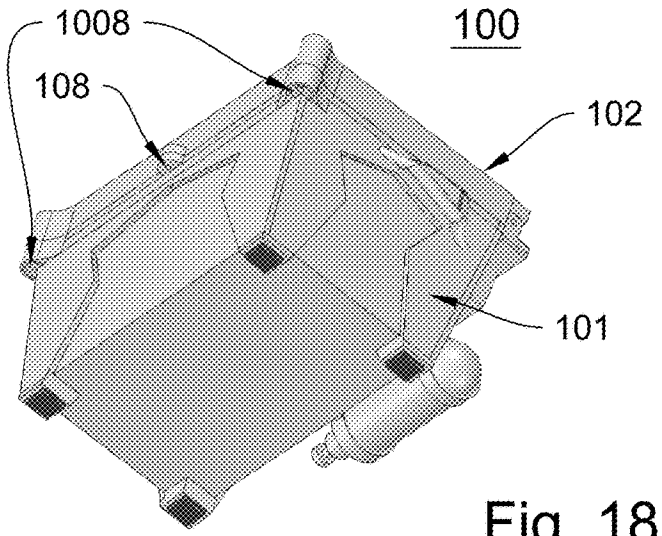
FIG. 18A is a perspective view from bottom right looking up of the present invention refrigerated food storage box disclosed herein, showing the placement of the quick lock and quick release mechanism of the lid on either side of the lid while a single pad lock hole is visible in the middle of the lid and main body.

FIG. 18A. Shows the ice chest cooler/hot box 100, location of the concealed quick lock and release mechanism at either side of the proposed ice chest cooler lid 102 and box 101 are shown. 1008 is shown from the bottom of the locking mechanism. Depressing 1008 can cause the mechanism to pop open the lid 102. In this embodiment, instead of two only a single pad lock hole, 108 is provided in the middle of the lid.

Figure 18B:
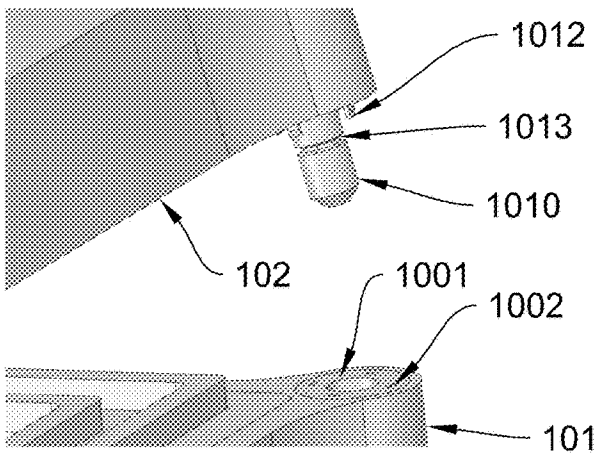
FIG. 18B is an extreme close up view of the lid and body of the present invention refrigerated food storage box disclosed herein, showing the male member and its various parts along with the cylindrical housing installed in the body of the unit.

FIG. 18B shows an extreme close up view of the lid of the ices chest cooler/hot box showing the arrangement of the quick lock and quick release mechanism of the unit.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

We claim:

1. A refrigerated food storage box comprising:

an inner box comprising a set of inner walls and an inner base, together enclosing a food storage compartment;

an outer box comprising a set of outer walls and an outer base, wherein each outer wall is located at a predetermined distance from a corresponding inner wall and the outer base is located at the predetermined distance from the inner base, thereby creating a thermal cavity between the inner box and the outer box;

at least one plate-type heat exchanger located within the thermal cavity, wherein each plate-type heat exchanger having a hollow cavity therein;

wherein the hollow cavity receiving temperature controlled air from a refrigeration unit, thereby altering the temperature inside the food storage compartment.

2. The refrigerated food storage box as claimed in claim 1 further comprising a hinged lid cover for covering a top portion of the refrigerated food storage box.

3. The refrigerated food storage box as claimed in claim 2, wherein the hinged lid cover has a cavity with a plate-type heat exchanger placed within.

4. The refrigerated food storage box as claimed in claim 1, wherein the set of inner walls and the inner base are made of food grade plastics.

5. The refrigerated food storage box as claimed in claim 1, wherein each of the outer walls and the outer base are doubled walled structure with an insulation cavity created between the double walls, the insulation cavity being installed with pressure injected insulation.

6. The refrigerated food storage box as claimed in claim 1, wherein the outer box and the inner box are interlocked with each other by a set of standoffs.

7. The refrigerated food storage box as claimed in claim 6, wherein each plate-type heat exchanger has through holes for allowing the stand offs to pass through and create and interlock the outer box with the inner box.

8. The refrigerated food storage box as claimed in claim 1, wherein the refrigeration unit comprises a vortex tube for producing streams of hot and cold air.

9. The refrigerated food storage box as claimed in claim 8, wherein the refrigeration unit further comprises a plurality of gas transmission lines for transferring one of hot and cold air from the vortex tube to the plate-type heat exchanger.

10. The refrigerated food storage box as claimed in claim 9, wherein the refrigeration unit includes a valve for selecting one of hot air and cold air to be transferred from the vortex tube to the plate-type heat exchanger.

11. The refrigerated food storage box as claimed in claim 1, wherein the thermal cavity is filled with a medium selected from water and ice.

12. The refrigerated food storage box as claimed in claim 11, wherein the thermal cavity is additionally mixed with cellulose fiber based saw dust is mixed with the medium selected from water and ice water in a ratio between 5%-15% by weight.

13. The refrigerated food storage box as claimed in claim 1, wherein the thermal cavity is filled with a mixture of water and at least one of Ethylene Glycol, aluminum oxide, and cellulose.

14. The refrigerated food storage box as claimed in claim 1 further comprising a set of retractable wheel assembly coupled thereto for transporting the refrigerated food storage box.

15. The refrigerated food storage box as claimed in claim 1 further comprising a quick engage and release locking mechanism for locking and unlocking the hinged lid cover with the rest of the refrigerated food storage box.

16. A refrigerated food storage box comprising:

an inner box comprising a set of inner wads and an inner base, together enclosing a food storage compartment;

an outer box comprising a set of outer walls and an outer base, wherein each outer wall is located at a predetermined distance from a corresponding inner wall and the outer base is located at the predetermined distance from the inner base, thereby creating a thermal cavity between the inner box and the outer box;

wherein each of the outer walls and the outer base are doubled walled structure with an insulation cavity created between the double walls, the insulation cavity being installed with the outer walls of the outer box;

wherein the thermal cavity being filled with a thermal storage medium for retaining temperature within the food storage compartment.

17. The refrigerated food storage box as claimed in claim 16, wherein the thermal storage medium is one of water, ice, ethylene glycol, aluminum oxide, cellulose, and a mixture thereof.

* * * * *